United States Patent [19]

Kuehnle

[11] 4,025,339

[45] May 24, 1977

[54] ELECTROPHOTOGRAPHIC FILM, METHOD OF MAKING THE SAME AND PHOTOCONDUCTIVE COATING USED THEREWITH

[75] Inventor: Manfred R. Kuehnle, Lexington, Mass.

[73] Assignee: Coulter Information Systems, Inc., Bedford, Mass.

[22] Filed: July 13, 1976

[21] Appl. No.: 704,780

Related U.S. Application Data

[63] Continuation of Ser. No. 434,699, Jan. 18, 1974, abandoned, and a continuation-in-part of Ser. No. 378,180, July 11, 1973, abandoned, which is a continuation-in-part of Ser. No. 323,132, Jan. 12, 1973, abandoned, which is a continuation-in-part of Ser. No. 260,848, June 8, 1972, abandoned.

[52] U.S. Cl. ..... 96/1.5; 252/501; 428/539; 204/192 P; 204/192 S

[51] Int. Cl.[2] ..... G03G 5/04; C23C 15/00

[58] Field of Search ..... 96/1.5, 1.8; 252/501; 204/192 OP, 192 S; 427/74, 85, 87; 428/539

[56] References Cited

UNITED STATES PATENTS

| | | | |
|---|---|---|---|
| 2,636,855 | 4/1953 | Schwarz | 204/192 |
| 2,844,493 | 7/1958 | Schlosser | 96/1.5 X |
| 2,899,372 | 8/1959 | Hanler | 204/192 |
| 2,962,375 | 11/1960 | Schaffert | 96/1.2 |
| 3,003,864 | 10/1961 | Schaffert | 96/1.5 |
| 3,095,324 | 6/1963 | Cusazo et al. | 96/1.5 X |
| 3,104,229 | 9/1963 | Koelmans et al. | 96/1.5 X |
| 3,418,229 | 12/1968 | Lakshmanel et al. | 96/1.5 X |
| 3,573,906 | 4/1971 | Goffe | 96/1.5 X |
| 3,630,873 | 12/1971 | Moore | 204/192 |
| 3,832,298 | 8/1974 | Weiss et al. | 204/192 OP |

OTHER PUBLICATIONS

Kay et al., "Photoconductivity in Sputtered Oxide Films", IBM Tech. Discl. Bull., vol. 12, No. 6, Nov. 1969, p. 851.

Lagnads et al., Rf–Sputtered Cadmium Sulfide Thin Crystals", Journ. Val. Sci. Tert., vol. 7, No. 2, Mar.–Apr. 1970, pp. 318–321.

*Primary Examiner*—Roland E. Martin, Jr.

*Attorney, Agent, or Firm*—Silverman & Cass, Ltd.

[57] ABSTRACT

An electrophotographic film which is not only capable of being utilized for the same purposes as conventional xerographic and electrofax members but it also capable of being used in the same manner as silver halide emulsion photographic films, that is, with high speed cameras for universal photographic purposes.

The electrophotographic film comprises a thin film coating of an inorganic, photoconductive, electronically anisotropic material one example of which is a specially sputtered cadmium sulfide bonded to a thin film layer of ohmic material which in turn is bonded to a thin, stable substrate member preferably formed of plastic sheeting. The total thickness of the photoconductive coating is about 3000 Angstroms, of the ohmic layer is about 500 Angstroms and of the substrate member is a fraction of a millimeter.

The product is durable with a hard, abrasive-resistant surface, is highly transparent and flexible notwithstanding the fact that the photoconductive layer is crystalline, and has high photoelectric gain with sufficient speed and sensitivity to be used as mentioned in high speed photography. As such it can accept a charge at a rapid rate and will retain the same selectively after exposure to enable practical toning with an almost infinite gradation of pigment values, i.e., gray scale. The electrophotographic film which is made using the cadmium sulfide as the photoconductive coating has substantially panchromatic response.

The photoconductive coating is novel and can be used in cases where its unusual characteristics provide functions other than required in the electrophotographic film. For example, the coating can be used in many places where it is not important that the entire assembly be transparent. It can be used on metal substrates in making economical circuit elements, for forming photosensitive devices, for making storage elements, in producing recording and transfer media and the like.

Novel methods of manufacture and use of the electrophotographic film and the photoconductive coating are disclosed.

88 Claims, 9 Drawing Figures

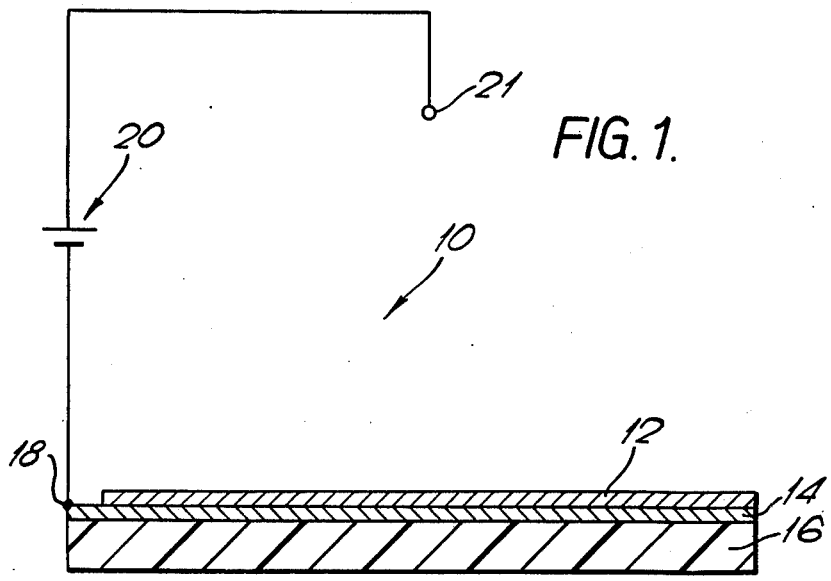
FIG. 1.
FIG. 2.
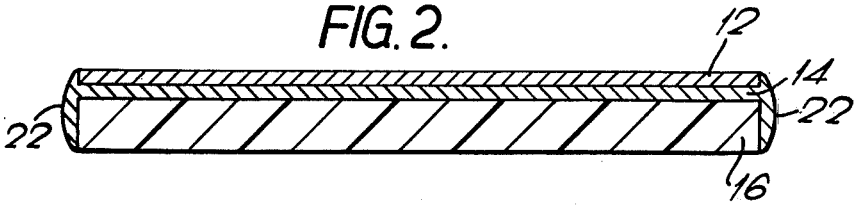
FIG. 3.
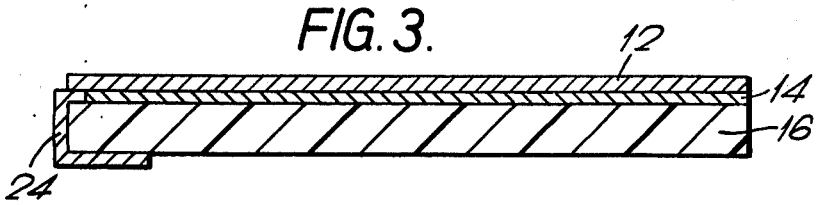
FIG. 4.
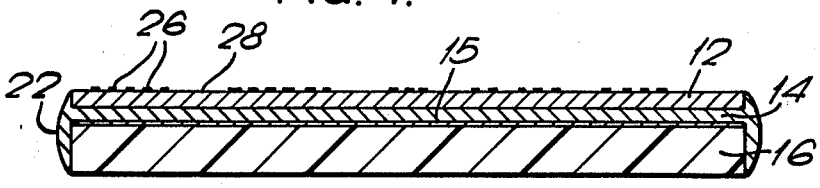

TRANSMITTANCE-SPECTRAL RESPONSE
OF CADMIUM SULFIDE.
COATING 12
PRIOR ART
254
256
252
250
PERCENT TRANSMITTANCE
100
90
80
70
60
50
40
30
20
10
4000A
5000A
6000A
7000A
8000A
9000A
10,000A
1μ
11,000A
1·1μ
12,000A
1·5μ
VISIBLE LIGHT
WAVE LENGTH IN ANGSTROMS.

FIG. 8.
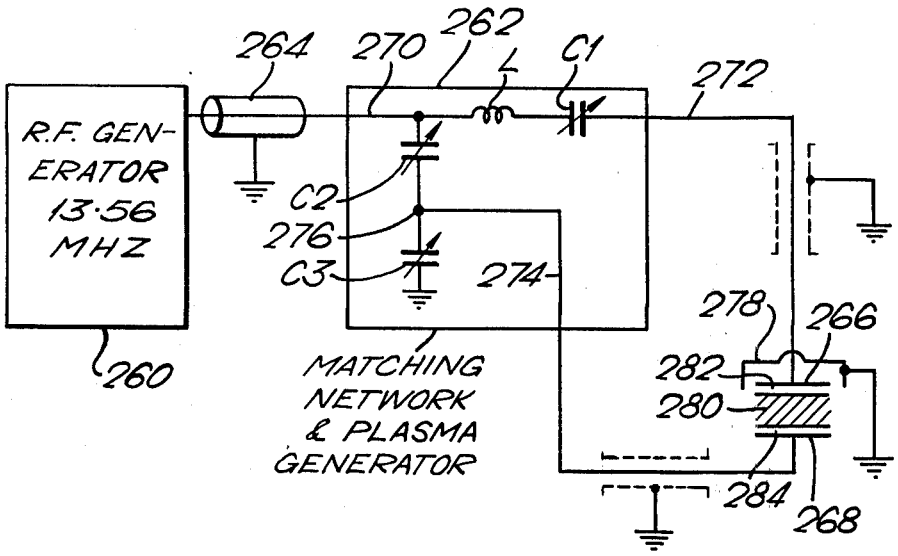
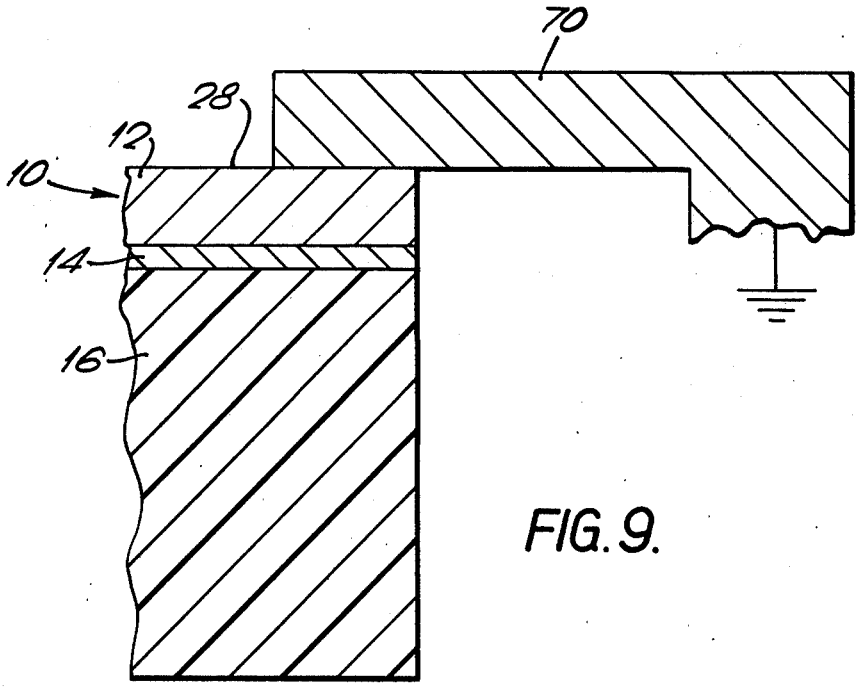
FIG. 9.

ELECTROPHOTOGRAPHIC FILM, METHOD OF MAKING THE SAME AND PHOTOCONDUCTIVE COATING USED THEREWITH

CROSS-REFERENCE TO RELATED APPLICATIONS

This is a continuation of Ser. No. 434,699, filed Jan. 18, 1974, now abandoned.

This application is a continuation-in-part of three copending applications as follows:

Application Ser. No. 378,180 filed July 11, 1973 entitled "ELECTROPHOTOGRAPHIC FILM, METHOD OF MAKING AND USING THE SAME AND PHOTOCONDUCTIVE COATING USED THEREWITH", now abandoned, which in turn is a continuation-in-part of the second copending application, Ser. No. 323,132 filed Jan. 12, 1973 entitled, "ELECTROPHOTOGRAPHIC FILM AND METHOD OF MAKING AND USING THE SAME", now abandoned, said copending application in turn being a continuation-in-part of the third copending application Ser. No. 260,848 filed June 8, 1972 and entitled, "ELECTRO-PHOTOGRAPHIC FILM", now abandoned.

Reference may be had to copending applications, Ser. No. 389,149 filed Aug. 17, 1973 entitled, "IMAGE RECORDING METHOD FOR ELECTROPHOTOGRAPHIC FILM" and Ser. No. 397,309 filed Sept. 14, 1973 entitled, now U.S. Pat. No. 3,864,035, "SHUTTERLESS CAMERA SYSTEM" for disclosures concerned with the method of use of the electrophotographic film of the invention.

All applications are owned by the same assignee.

BACKGROUND OF THE INVENTION

This invention relates to a novel electrophotographic film and to a photoconductive layer or coating comprising one of the components of the said electrophotographic film.

The photoconductive material which forms the coating is produced by a special sputtering process to achieve the properties which will be detailed below. In the case of the electrophotographic film, the coating is laid down in a thin film layer on a substrate which is preferably transparent and flexible, with an ohmic layer interposed between the substrate and the photoconductive thin film layer or coating. The photoconductive coating will be specifically described hereinafter as cadmium sulfide although zinc sulfide and other substances discussed in detail are useful as photoconductive thin film coatings of a similar nature when applied according to the invention.

The expression "thin film" is used herein, both in the specification and in the claims. As a general rule the scientific literature in some way attempts to define thin film in terms of the properties of the substance being discussed, calling attention to those properties in contrast to the properties of the same substance in bulk. This latter is called "bulk properties" herein. Speaking in relatively simple terms, some materials act differently when constituted as a "skin" than they do as a "body." Reference may be had, for example, to a publication entitled "Thin Films" by Leaver & Chapman, Wykeham Publications (London) Ltd., 1971 for a general discussion of the differences between thin film and bulk properties of the same type of material. In that publication, the thickness of a "thin film" is given as "usually less than one micron." This general definition is required in view of the breadth of the subject covered in that publication.

When one considers the purposes and requirements of the structures in which a certain category of material is to be used, the boundary or boundaries between the thin film and the bulk properties must take these purposes and requirements into consideration. Properties which are of no importance or interest to the solution of a problem do not enter into the matter and hence should not establish the physical criteria. For example, if a radical change in the sound reflecting property of a certain material occurs when the material is made about 2 microns thick and less because of skin effect, then if that material is going to be used in an environment which uses the sound reflecting property, it is exhibiting a thin film effect. On the other hand, if that identical material changes its resistivity radically only when its thickness is decreased to 0.5 microns or less then, for the conditions of use in which its resistivity is of importance, the material is still a bulk material at thickness greater than about 0.5 micron.

The use of the materials involved herein relate to several properties which are beneficial and advantageous for the invention, and the meaning of the expression "thin film" as used herein will be related only to these properties, irrespective of the properties of any other materials for any other purposes which may have been referred to as thin films in thicknesses other than those which will be defined. The words "thin film" when used in the specification and in the claims will be taken to mean a thickness at which the desired properties of the material in question cease acting as bulk properties and commence acting as a skin or thin film. Examples which have actually been made is substantially less than a micron (10,000 Angstroms) and very few of the coatings or layers tested exceed 5,000 Angstroms. Accordingly, a thin film will be considered one that is substantially less than a micron thick.

Considering the prime example of the photoconductive coating herein, namely pure cadmium sulfide, the anisotropy which is essential to the invention is exhibited in all examples which were made, none being much over 6,000 Angstroms thick. The transmissivity requirements of the invention which relates to the ability of the photoconductor to absorb photons were optimum (between 70% and 85%) when the coating was between 8500 and 2500 Angstroms in thickness. The high dark resistivity of the film occurred only when the thickness of the film was below 6000 Angstroms.

With respect to the thin film ohmic layer, which will be described, its desired properties were conductivity, bonding ability and transparency such that when a desirable photoconductive coating is carried thereon the total light transmissivity of the electrophotographic film will be 70% and 85%. This was achieved by a layer several hundred to about 500 Angstroms.

The total thickness of both the photoconductive and the ohmic layers on typical electrophotographic films ranged from 3500 to 5000 A or 0.3 to 0.5$\mu$.

The expression "photoelectric gain" as used herein has a meaning requiring explanation. The speed and efficiency of an electrophotographic member is directly related to the "hole-electron pairs" produced when subjected to light. In prior art photoconductive coatings used in xerography or electrofax, it requires many photons (extremely bright light) to produce a single hole-electron pair. The number is usually upwards of a thousand. It follows that if electrophotographic film such as that of the invention can produce a hole-electron pair upon the incidence of a single photon or even two ½ photons its "photoelectric gain" is very substantially greater than that of the prior art. Accordingly, in order to provide an expression for the gain of the invention, "high photoelectric gain" will be intended to mean a condition in which it requires at most one photon to produce a single hole-electron pair.

Reference will also be made hereinafter to "high speed". The criteria of prior art electrophotographic members furnishes no real comparison since the speed of the electrophotographic film of the invention is so much faster than the speed at commercial members. In fact there is no commercially available electrophotographic transparent film.

Attempts to establish a comparison of speed between the electrophotographic film of the invention and ordinary photographic film are at most qualitative. When charged, the film of the invention can be exposed at high speeds such as of the order of 0.01 second. Since A.S.A. ratings have been devised for negative film of the silver halide type and take into account contrast, fogging and other photographic factors they really don't apply here. Suffice it to say that exposures can be made at speeds comparable to those of silver film. Doping can increase speed substantially.

The expression "electrophotographic film" or "photographic film" as used herein is intended to mean a complete article with several layers or lamina for use in some photographic process. Reference to the substrate or substrate member or substrate means will not include the use of the word "film" although the substrate which is contemplated by the invention could be considered a film in the ordinary meaning of the word. As will be seen, it is preferred that the substrate be a thin flexible transparent member of plastic sheeting, commonly known as plastic film.

In electrophotographic processes as known, an electrostatic latent image is formed on the surface of a photoconductive member. The photoconductive member is initially charged over its entire surface while in the dark, the charge being retained, if at all, for a period of time which is primarily dependent upon the physical character of the material or materials from which the photoconductive member is made. Immediately after the surface has been charged, such surface is exposed to some form of radiant energy comprising a pattern of tones, lines, text and the like which it is desired to reproduce. Such radiant energy may take the form of a projected light pattern, an X-ray projection, etc.

The areas of the surface of the photoconductive member which are exposed to the brighter portions of the pattern become more conductive than those which are exposed to the less illuminated portions of the pattern. There is a conductive member immediately below the photoconductive member which forms the ground plate to enable charging the photoconductive member initially. The selective conductivity of the illuminated portions of the photoconductive member selectively and proportionally discharge the electric charge from the different areas of the surface of the photoconductive material in accordance with the respective degree of illumination thereof.

Not all materials will accept a charge initially, and of those which accept a charge many will immediately leak off so that even without illumination the charge decays so rapidly that it is almost useless. The application of toner demands charge retention.

In addition to accepting a charge and retaining it in darkness, the photoconductive layer is required to discharge in the light areas to a degree which is fairly rapid and generally proportional to the amount of impinging light. The amount of discharge of a photoconductive member is a measure of its gain, that is (as defined above) the number of photons which will be required to discharge a surface electron and the ability of the member to permit the recombination of the hole electron pairs. In prior art members, and where charge at the surface is positive a conductive layer is needed to aid in discharge, but, as will be seen, this is not the case with the preferred embodiments of the invention. Most known electrophotographic members such as the xerographic plates and the electrofax sheets popularly used have very low photoelectric gain. To be comparable with the silver halide emulsion films of today, gains would have to be enormously greater than those of these prior art photoconductors, but until the advent of the invention this has not been accomplished so far as known. The rate of discharge of a member for a given light intensity when exposed is a measure of the speed of the photoconductive member. This rate is measured in seconds and at best fractions of seconds in known photoconductive members. As will be obvious, modern high speed photographic films can be exposed in milliseconds. As will be seen this latter is also practical with the photoconductive material of the invention.

Another aspect of photographic films which finds little counterpart in most electrostatic processes used for reproduction or copying purposes is the continuous tone gray scale. The dark parts of the pattern are represented by the retention of charge and the light parts are represented by discharge. Known electrostatic members cannot discharge fully, even in the brightest of light. The charge retention properties are not good enough to provide the dense black that most photographic films can achieve.

Continuing with the discussion of known electrophotographic processes, the resulting geometric pattern of charge on the surface of the electrophotographic member, whether in xerography or electrofax, constitutes the latent image mentioned above. The charge, if sufficient in potential, has the property of being able to attract fine particles suitably polarized, electrostatically. In the art of xerography and electrofax, such fine particles in the form of a comminuted pigmented powder or liquid suspension thereof are brought into contact with the surface. The particles selectively adhere to the surface in varying degrees according to the charge pattern represented by the latent image, following which the excess is brushed or otherwise removed from the surface and the remaining toner, as the particles are called, forms a visible image. In xerography, this visible toner image is transferred to a receiving element such as a sheet of paper and is permanently fused or "burned" to the surface of the receiving element by techniques which are well known. In electrofax there is no transfer, the image being fused to the electrophotographic member and this latter becomes the copy.

The problems alluded to arise in connection with providing a tonable image. There must be sufficient surface potential to result in enough charge to attract the particles; there must be sufficient charge to provide dark increments where the image is dark; the charge must remain in place and not leak off in a period of time that the mechanical problem of bringing toner to the surface, and if effected, or transfer or fusing occurs. In this latter respect, even if there were an excellent image produced by the charge and toner (assuming that the toner is not self-adhering) but the charge leaked off to a substantial extent in the period of time required to bring the toned image into engagement with the transfer sheet or into juxtaposition with the fusing apparatus, then a large portion of the toner would have dropped off. The image would be light or spotted.

The xerographic and electrofax processes as known are not readily adaptable to the same purposes as present day photography. Further, the inherent characteristics of these processes proscribe their likelihood of ever being useful in high speed photography. The most familiar xerographic process of the present time utilizes a large metal drum coated with amorphous selenium as the photoconductive member. The photoconductive member has extremely low gain and is very thick — of the order of a fraction of an inch — in order to be able to build up a sufficient charge to enable toning. Low surface potnetials during charging require longer toning times. The process performed is complex, occurs in a complicated and expensive machine, and the speeds, resolution and flexibility of such machines and the processes thereof leave much to be desired. Electrofax equipments of the present time utilize zinc oxide coated conductive paper which is charged, exposed, led through a toner bath and fused. The photoconductive gain is again low, the resolution crude, the gray scale short and limited, the equipment complex and bulky.

Neither of the processes of the prior art described is capable of being embodied in a small hand-held camera, and even if this could be done, neither process nor any other known process is capable of approaching the speed and quality achieved by the ordinary high speed camera using fine grain silver halide emulsion photographic film. The invention has this capability.

Inherent faults with the known methods, apparatus and the photoconductive materials and articles used have prevented use in such fields as high speed photography, fine resolution microphotography, and many other technical areas. Record-keeping, by means of projectable microfilm is a field wherein there is a long-felt need for a process for making the photographic member quickly, with high resolution, economically, with simple apparatus and having the ability to withstand long periods of storage. For example, it would be highly desirable to add information to a microfilm record from time to time without adversely affecting the information which is already contained thereon.

Conventional photographic microfilm is not capable of being re-exposed for adding information. The inherent construction and processing thereof causes an irreversible chemical change when the microfilm is developed. The general electrophotographic process above-described could provide a suitable microfilm record if it could be used to make a transparent electrophotographic film having high resolution and prolonged storage life. As can be seen, if the photoconductive coating of such electrophotographic film could be preserved indefinitely, then each time that an addition is to be made to the record already contained on the coating, one merely charges the surface of the coating, exposes the same, and fixes the new image to the surface. This presumes that toner is applied directly to the surface and fused to the surface permanently and that the film is transparent.

Known experimental transparent electrophotographic recording elements are susceptible to deterioration on prolonged exposure to light, elevated temperatures and humidity. They must be handled carefully, stored under controlled conditions and can be re-exposed only a limited number of times. Their use for records of a permanent nature is highly limited. Accordingly, it is impractical to utilize the same for such records. None is known to be commercially available.

The above discussion considers only a limited aspect of the prior art deficiencies. A consideration of some of the problems solved by the invention will emphasize that the advance in the art by such invention is not confined to a small area.

The conventional silver halide gelatine coatings of photographic film achieve greater speed and better resolution than known electrophotographic members of the so-called xerographic and electrofax type. Nevertheless, such gelatin emulsions are subject to disadvantages which are obviated by the invention, in addition to the fact that the electrophotographic film of the invention can be repeatedly exposed to add information to the same without deleterious effects.

The conventional silver halide film of 140 microns thickness has an emulsion which is about 20 microns thick. The thin film photoconductive coating of the article of the invention is a fraction of a micron thick. The conventional silver halide film is thus not easily flexed without damage. Its resolution is determined by the size of the silver grains; the bigger the grain, the faster the film. In production, the film cannot be inspected in ordinary light, it cannot be handled or transported except in special dark packages. The emulsion is soluble in ordinary liquids and is hygroscopic.

The electrophotographic film of the invention, on the other hand, is highly durable. Its thin film coating is extremely dense and hard as glass; insoluble in most liquids; has extremely fine resolution; is produced by sputtering processes in pressure vessels and hence is free of bubbles; is not affected by light and hence can be handled freely and readily inspected under bright light. Because it is a semi-conductor, it is nonhygroscopic and not subject to deterioration on account of any of the factors which will deteriorate the ordinary silver emulsion type of photographic coating. Fungus or other microorganisms have no effect on the electrophotographic film of the invention.

The ordinary unsensitized photographic emulsion and such electrophotographic coatings as known have a relatively limited spectral response. The photoelectric gain of known electrophotographic coatings is substantially less than that of the article of the invention which accounts to a large extent for the inability of prior electrophotographic films to have the extremely high speed of the invention.

The photoconductive coating of the invention is independently novel because it exhibits properties which have not been known in such substances. These properties will be detailed hereinafter, but for the moment, the coating is a thin film, extremely dense, highly ordered microcrystalline, wholly inorganic, has extremely high photoconductive gain, has ability to accept extremely high per unit surface potentials, retains charge in darkness for periods of time enabling complete toning, is extremely light sensitive and is substantially panchromatic. It is applied by a sputtering method using radio frequency sputtering equipment, but the method is modified by establishing a second dark space adjacent the anode in addition to the normal cathodic dark space which produces the extremely dense highly ordered crystalline deposits.

The photoconductive materials known have some degree of photoconductive persistence which is annoying since it prevents high speed exposure and sharp images. When subjected to light, the discharge of the photoconductive coating commences, but when the light is cut off, most prior art coatings continue to discharge for some time. In the coating of the invention there is no photoconductive persistence when the exposure is completed. The discharge immediately is cut off when the coating is placed in darkness, giving the high speed and high resolution images described herein.

SUMMARY OF THE INVENTION

According to the invention, there is provided an article of manufacture for use as an electrophotographic film which comprises a substrate member of flexible, transparent sheeting having a thin film coating thereon, the thin film coating comprising a sputtered photoconductive material such as for example cadmium sulfide, zinc indium sulfide, or similar photoconductors, there being an intervening thin film layer between the substrate member and the photoconductive coating, the said intervening layer comprising an ohmic layer of indium oxide either alone or with a small percentage of tin oxide or the like. All layers are thoroughly bonded to one another.

The photoconductive coating comprises another facet of the invention.

The article can be used in accordance with the known techniques of xerography and electrofax but has functions and characteristics which render it substantially superior to any known electrophotographic film or structure. It is capable of being used in an unusual manner to achieve superior results as detailed in the specification. The thin film coating of photoconductive material is capable of being charged by corona or other means at very high speed and retains the charge sufficiently to enable the surface thereof to be exposed to radiation of a pattern which it is desired to reproduce on the film. The radiation causes the charge to leak off the surface selectively and proportionally to the degree of exposure of the respective increments of the photoconductive exposed surface. The ohmic layer serves primarily to enable the charging of the photoconductive thin film layer to leave the initial even distribution of charges within the surface. If a p-type photoconductive thin film layer could be used, the ohmic layer would aid in discharge. The substrate member is a mechanical support for the ohmic layer and the photoconductive layer. There may be several thin film photoconductive layers acting in concert.

The photoconductive coating of the invention is produced by radio frequency sputtering using a sputtering apparatus but the output of the R.F. generator is constructed in such a manner that the resulting plasma which is established between the target and anode has two dark spaces. The anode, of course, is the substrate holder and the molecules passing through the plasma will be directed toward the anode and engage the intervening substrate to build up a coating thereon. One of the dark spaces is that which occurs normally between the plasma and the target or cathode. In cases where the anode is at ground potential which is the usual situation, there is normally no other apparent dark space. The second dark space occurs between the plasma and the anode when the anode and cathode are connected in such a manner that there is a so-called bias on the anode. There is normally a shield which is arranged around the cathode the shield being grounded.

The characteristics of the resulting coatings are different to a radical degree from previous photoconductive coatings produced by any of the known methods of deposit including conventional sputtering. Even the same materials used in the invention, such as cadmium sulfide when sputtered by conventional methods do not produce the same results as the coatings of the invention. Cadmium sulfide coatings of the prior art made by spraying, mechanical coating, or other methods are also incapable of approaching the desirable characteristics of the invention.

Incorporating a thin film of a coating comprising cadmium sulfide produced according to the invention into an electrophotographic film results in the following characteristics among others which will be detailed in the specification which follows:

a. excellent charge acceptance and retention for a sufficient period of time to provide for toning completely and rapidly;
b. extremely high photoelectric gain to provide extreme ranges of darks and lights with extraordinary (practically infinite) gradations of grays between;
c. extreme flexibility despite the crystallinity when the combined thickness of the photoconductive coating and the ohmic layer is bonded to a substrate of flexible plastic sheeting;
d. transparency of the coating to a degree providing for passage of 70% to 85% of incident light, even when combined with the ohmic layer, thereby enabling projectable transparencies to be made when the substrate is transparent; in any event aiding in the charge and subsequent discharge of the coating upon exposure to light;
e. broad photoelectric spectral response of the coating to radiation, especially in the visible range;
f. durability, stability, abrasion-resistance, absence of light fatigue, adhesion to the ohmic layer and the substrate; and
g. feasibility for economic production in quantity.

The photoconductive coating is preferably applied to a conductive or ohmic layer which in turn is carried on an organic polymeric sheeting member which provides great flexibility. Exposure is achieved by first charging the photoconductive coating in darkness and then exposing the charged surface to a light pattern. Charging is done at a rate which is faster than in the case of known electrophotographic members. The charge potential to which the surface is charged is in many cases carried substantially above a certain lower charging potential of the surface to a potential level which may be termed "maximum" and which is to be discussed, but, since the coating is an extremely thin one, a very low voltage — say of the order of 40 to 50 volts surface potential represents a voltage per unit thickness which is 10 times higher than that of the conventional xerographic member whose surface is charged to 500 volts or the like.

The sensitivity of the electrophotographic film is related to the surface potential, so that in effect the higher the unit potential, the higher the charge and the greater the sensitivity. For bright patterns charging need not be to as high a potential as in the case of patterns of lesser light value. Thus, the user can adjust the sensitivity of the film as he desires in accordance with the brightness of the subject matter he is going to record. Reference may be made to copending applications, Ser. Nos. 389,149 and 397,309 now U.S. Pat. No. 3,864,035 for details.

Following exposure, the electrophotographic film is toned and the toner may be fused in place or transferred to a receiving member. The characteristics of the film include the ability to retain charge for relatively long times enabling the user to tone the film, examine the resulting image and wipe it off if not satisfactory. Under such circumstances, the film is simply replaced in the recording apparatus, which may be a small hand-held camera, and another exposure made. The examination and wiping off of the toned image before fusing or transfer can be effected an almost infinite number of times without in any way damaging or wearing the photoconductive surface and without decreasing its ability to achieve sharp, high quality images again and again.

If fused in place, the image is permanent, but does not adversely affect the photoconductive coating — hence additional images can be placed directly upon the same electrophotographic film and fused in place to any desired extent. If the ohmic layer and substrate are transparent, which is preferred in electrophotographic film, the resulting article becomes a transparency that can be projected readily.

The coating can be sputtered onto conductive members, glass substrates and the like for taking advantages of its properties in many different fields.

BRIEF DESCRIPTION OF THE DRAWINGS

FIG. 1 is a highly schematic sectional view of a transparent electrophotographic film constructed in accordance with the invention and illustrating diagrammatically a circuit for charging the surface of the photoconductive layer;

FIG. 2 is another schematic sectional view through a similar slightly modified electrophotographic film;

FIG. 3 is similar to FIG. 2 but illustrating a slightly modified form;

FIG. 4 is a view similar to that of FIG. 2 but illustrating schematically the manner in which toner is applied to the surface of the photoconductive layer after the same has been exposed;

FIG. 8 is a simplified electrical schematic diagram illustrating the circuitry of a sputtering apparatus used to deposit the photoconductive coating of the invention; and FIG. 9 is a fragmentary sectional view through an electrophotographic film showing a method of discharging same.

DESCRIPTION OF THE PREFERRED EMBODIMENTS

The invention herein is characterized by the provision of a new article of manufacture, the method of making the same and the method of utilizing the same. The invention also includes a novel photoconductive thin film coating.

The electrophotographic film of the invention comprises said thin film coating in the form of an inorganic photoconductor overlying a thin film layer of an ohmic or conductive material which in turn is bonded to a substrate. The preferred form of substrate is a thin flexible insulative substrate such as plastic sheeting of high stability. The ends sought for the electrophotographic film of the invention are charge acceptance transparency, great sensitivity, high photoelectric gain, economy, ease of manufacture and use and handling, ability to be exposed over and over again, stability under varying conditions of light, heat, humidity, and other properties which will be apparent from the description which follows. When the preferred substrate is used, the electrophotographic film is highly flexible.

The attributes of the invention give rise to a wide variety of important uses not the least important of which is its use as microfilm records. The photoconductive coating has many uses besides an electrophotographic film.

The three important elements of the electrophotographic film 10 comprises the thin film coating 12 of photoconductive material, the ohmic or conductive thin film layer 14 and the substrate 16. Each of these elements will be described and discussed in detail hereinafter, but for the purpose of acquiring an appreciation of the invention it is believed that a discussion of the overall electrical characteristics will be valuable. This is especially true in making a comparison of these characteristics with those of a conventional type of xerographic or electrofax plate or member.

Figure 5:
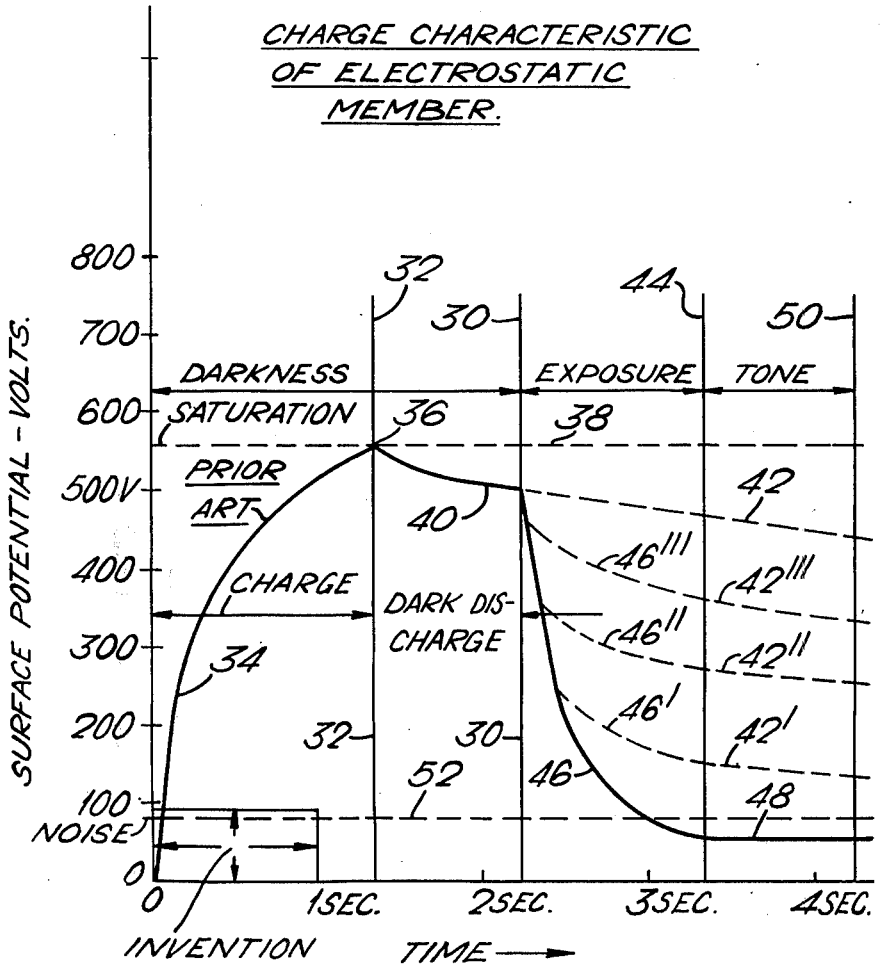
FIG. 5 is a chart illustrating the prior art and showing the charging and discharging voltages for a typical xerographic plate.

Attention is invited to FIG. 5 which is a chart showing the characteristics of a typical xerographic plate of the prior art.

The horizontal axis of FIG. 5 is time increasing to the right in seconds and the vertical axis is surface potential increasing upward in volts. The actual values for the phenomena illustrated are typical and may be somewhat greater or lesser than indicated. The graph is divided into four time zones which represent the complete process having occurred through toning, the following event comprising either transfer and fuse or fuse alone in the case of electrofax systems.

The prior art electrostatic members most widely used at this time are made out of amorphous selenium or zinc oxide — resin mixtures. The selenium is coated onto a metal drum and the zinc oxide mixture is coated onto a sheet of conductive paper. Typical thicknesses of these coatings are from 20 to 160 microns (1 micron $= 10{,}000\ A = 1 \times 10^{-6}$ meter).

The first zone illustrated is designated DARKNESS and extends for the first couple of seconds of the cycle. The end of the period is at the time 30. This period is divided into two sections, the first of which terminates at about 1.4 seconds as indicated at 32 and the second of which comprises the remainder of the period. The first section is designated CHARGE. During this time, the electrostatic member is in darkness and is being subjected to a very high voltage (of the order of kilovolts) corona. The surface of the electrostatic member accepts the charge to a degree which depends upon its characteristics. The surface assumes a surface potential which is indicated by the charge line 34 rising to somewhat over 500 volts at the point 36. This point coincides with a surface potential which is considered the saturation voltage of the electrostatic member. Theoretically, the charge leaks off at the same rate it is being applied at saturation. The saturation level is designated by the broken line 38.

While still in darkness, the second section of the period begins at the time 32. The corona having been discontinued, the electrons representing some of the charge commence to seek the conductive member in contact with the opposite face of the electrostatic or photoconductive member, to be carried away. These are assisted by free carriers in the photoconductive layer not driven wholly toward the conductive surface by the charge because the thickness of the layer prevents field effects from the charge from doing so. As electrons leave the photoconductive member, the charge dissipates and the surface potential starts to decrease. This decrease in potential is represented by the curve 40 which is shown in solid line between the times 32 and 30. If the electrostatic member remained in darkness thereafter, the curve 40 would continue to drop along the broken line 42 shown to the right of the time 30. The curves 40 and 42 are known in the art as the dark decay characteristic of the electrostatic or electrophotographic member.

Thus, the time scale of the graph of FIG. 5 spreads out over four seconds and more. The slope of the dark decay characteristic 40–42 is reasonably flat but drops away quickly when one considers the functions that must be performed. The member accepts charge relatively slowly as indicated by the curve 34. So far as known, the charge sits effectively "on" the surface of prior art electrophotographic members.

The third time zone is between about 2.3 seconds and 3.3 seconds and it is in this period that the electrophotographic member is exposed to a light pattern. The period ends at 44. The period is referred to as EXPOSURE in FIG. 5. In this period of time, while the orginally applied charge is decaying along the curve 42, the photons of the light pattern are producing electron-hole pairs and causing the migration of electrons of charge away from the surface of the electrophotographic member and combination with holes. An extremely bright light is required to cause the discharge along the curve 46, this being known as the light decay curve. Note that the curve is not steep by any means and that the discharge is not complete, there being a residual charge remaining, represented by the curve 48. This corresponds to a surface potential of about 35 volts, which is typical for prior art electrophotographic members. As will be seen, the intensity of light needed in such prior art xerographic member to achieve the discharge represented by the curve 46 is at least thousands of times brighter than the light required to achieve total discharge of the electrophotographic film of the invention herein.

The intermediate degrees of light represented by the various shades of the pattern will produce light discharge curves 46', 46'', 46''', etc., each of which discontinues when the exposure is completed (shutter closed) after which the degree of charge remaining for the particular increment continues along a downwardly displaced dark discharge characteristic. These are shown at 42', 42'', 42''', etc. This carries the graph of FIG. 5 into the fourth period which commences at the time 44 and terminates at 50.

This last period is called TONE and occupies about one second. In this period the exposure has been complete, the latent image which is produced by virtue of exposure and which is fully developed at 44 is now subjected to the toner particles. There must be sufficient time in the period between 44 and 50 to enable the movement of the electrophotographic member and the toner particles relative to one another and for the toner particles to adhere. Furthermore, the charge on the electrophotographic member represented by those increments which have been in darkness and partial darkness must remain in place sufficiently to enable the toner to adhere. The toner in turn must adhere until the fusing or transfer step takes place. This latter will occur after the time 50.

Note that the residual charge at 48 will cause adherence of toner even where the most brilliant light has impinged against the electrophotographic member. Thus, with the prior art, dead white areas are most unlikely to occur to the finished image. Likewise, the dark decay curve 42 has fallen away quite rapidly at 50 from the maximum charge potential at 36 so that dead black is also an unlikely effect. The gray scale between these two extremes is also not of photographic quality. Even more important, solid pigmented areas to be reproduced emerge black at their edges and light in the center. This annoying edge effect is a characteristic which renders xerography almost useless for quality photography or photographic reproduction.

One disavantage of the prior art not clearly demonstrated is photoconductive persistence. When light is cut off at the time 44, there is a continuing discharge which is a kind of photoconductive inertia. It varies for different materials. The effect would be graphically represented by a slight continuation of curves 46', 46'' and 46''' into the toning period before they start their respective dark discharge characteristics. As will be seen, in the coating of the invention this persistance is nonexistent. The corresponding transfer from light discharge to dark discharge is abrupt and sharp. This represents high speed exposure and provides high resolution images.

The prior art equipment will provide for the fusing or transfer of the toned image. In the case of fusing, the electrophotographic member is passed through a toner bath which becomes depleted as the apparatus is used so that the images become lighter and lighter. This is characteristic of the electrofax process. The liquid evaporates or is dried from the member when the fusing takes place. In the case of transfer, the drum is pressed against a sheet of paper while an electric field is applied, the paper image is fused while the drum is brushed and totally discharged by brilliant light, if necessary ready for the next image. This latter is the xerographic process.

According to the invention, the photoconductive coating of the invention is at most a fraction of a micron in thickness where transparency is essential. The coating is extremely dense and exhibits the advantageous attributes mentioned because of its physical composition. The thinness enables extremely thin, flexible and transparent electrophotographic members to be constructed, but provides advantages in other structures as well.

Figure 6:
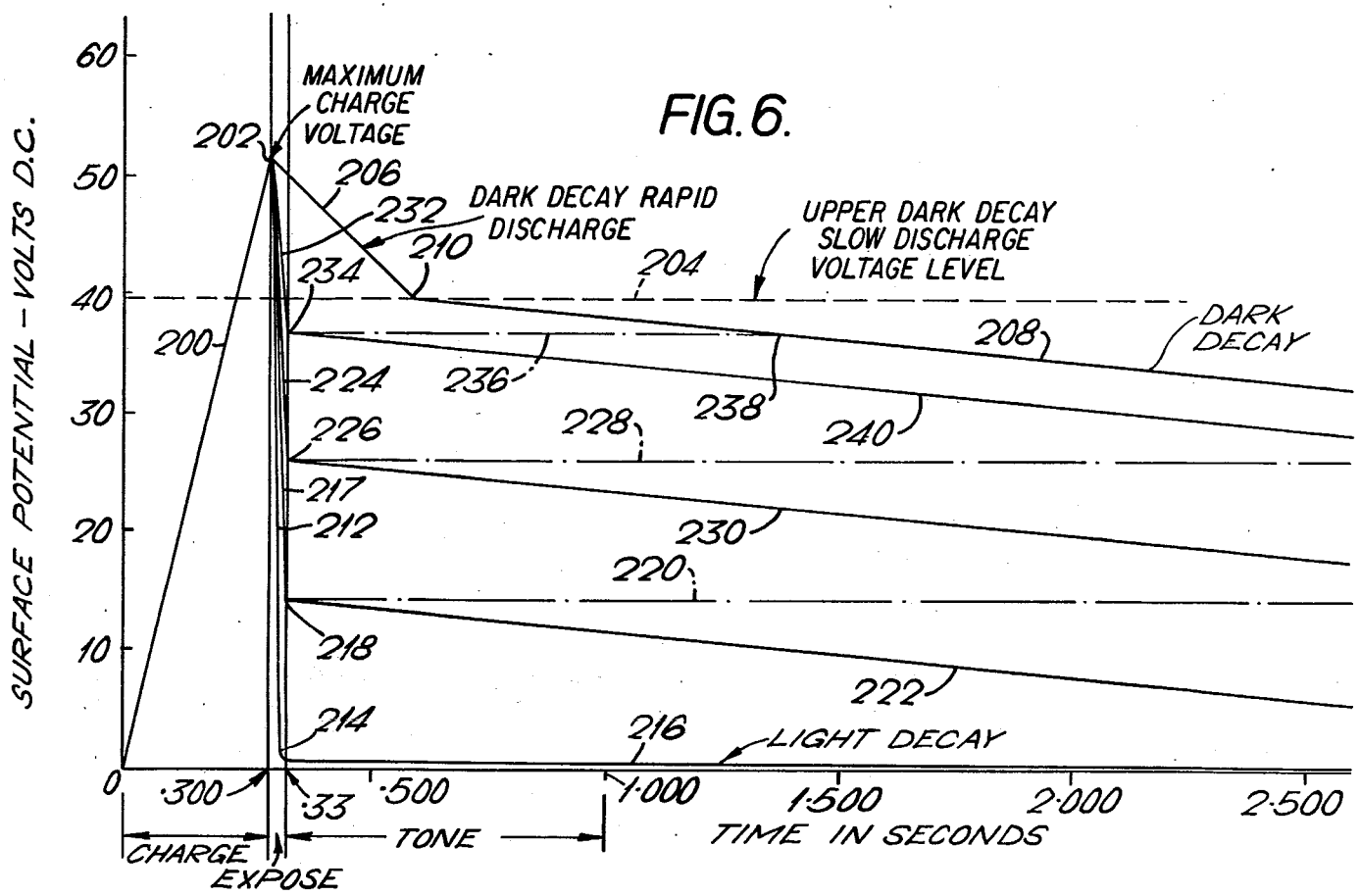
FIG. 6 is a chart similar to that of FIG. 5 but illustrating the charging and discharging voltages for an electrophotographic member constructed in accordance with the invention.

The actual voltages which are involved as seen in FIG. 6 are substantially less than those for the thick electrophotographic coatings of the prior art and yet the field strength per unit thickness is much higher than that of the prior art members. It is approximately $10^6$ volts per centimeter as compared to $10^4$–$10^5$ volts per centimeter for other material. The other characteristics are radically different as will be seen from a comparison between FIGS. 5 and 6 as discussed below.

Preliminarily in making this comparison, one should note the very small block drawn in the lower left-hand corner of the graph of FIG. 5. This block represents all of the events through toning of the graph of FIG. 6 drawn approximately to the same scale as that of FIG. 5. Thus, the voltages involved in FIG. 6 are a fraction of those in FIG. 5. As a matter of fact, the dashed line 52 drawn at 50 volts in FIG. 5 represents the electrical noise level in the systems represented by that graph, so it can be seen that all of the events occurring in the use of the photoconductive coating of the invention occur in the area of the prior art members which is considered practically useless. There is no noise in the system of the invention. One should also note that the image in the case of the invention as shown in FIG. 6 has been fully toned before the prior art photoconductive member has reached its maximum charge, let alone has been exposed and toned.

FIG. 6 illustrates the functions and characteristics of the photoconductive coating of a typical electrophotographic film which has been constructed in accordance with the invention and which is used in the manner described.

The thinness of the coating, its photoelectric gain and substantial ratio between dark and light decay characteristics result in the great difference in time and voltage quantities represented on the chart of FIG. 6 when compared with similar quantities of the photoconductive layer of a typical electrophotographic member of the prior art as represented in FIG. 5. The durations of the various functions are substantially less and so are the voltages involved.

The invention contemplates that the coating may be quickly charged, that is, shocked, to a relatively high voltage which is called the "Maximum Charge Voltage." This is somewhat in the nature of the saturation voltage of prior art electrophotographic members but is believed to be somewhat different. The reason for this is that the dark decay curve drops from this point quite rapidly in a nonlinear manner as though the Maximum Charge Voltage were above saturation and then levels off to a more or less linear slow decay commencing approximately at the level 204 of the chart of FIG. 6. The latter level is called "Upper Dark Decay Slow Discharge Voltage Level" herein because that seems to be the only description that fits. It is from this approximate level that the dark decay is not as steep as it slowly decays.

The high rate of charge is commensurate with the ability of the electrophotographic member of the invention to accept charge rapidly and this rate seems to be quite linear when compared to the relatively slow rate of charge of the prior art member as typically shown in FIG. 5 at 34. In about 300 milliseconds, the coating of the invention acquires a charge that reaches a potential of 52 volts.

The charge line is substantially linear as shown at 200 and the point of Maximum Charge Voltage is shown at 202 well above the Upper Dark Decay Slow Diacharge Voltage Level which is indicated by the dashed line 204. From the point of Maximum Charge Voltage at 202, the surface potential of the film will decrease at a rate which is dependent upon the amount of light to which the film is subjected, if any. If, from the Maximum Charge Voltage point 202 the film remains in total darkness, the surface potential will follow the characteristic dark decay curve for that film and for the particular initial surface voltage 202. The dark decay curve is composed of two sections, the initial Dark Decay Rapid Discharge section 206 which is relatively steep compared to the remaining section 208, and the last-mentioned section, which carries the characteristic of surface potential decay substantially later in time.

The Dark Decay Rapid Discharge section 206 represents the decay of the surface potential from the voltage at the instant of completion of charging to the voltage of the level 204. This is believed to be at a rapid rate because the film surface has in effect had charge forced upon it and the discharge will be consequently quite rapid; nevertheless, it will be appreciated that the charge is retained at field levels which are not attainable by other electrophotographic members an example of which is described in connection with FIG. 5. When the Upper Dark Decay Slow Discharge Level is reached as shown at 210 in the chart there has been a lapse of time which is well past the exposure period and well into the toning period. It is pointed out, however, that even though this has taken place, the total elapsed time to the point 210 is only 600 milliseconds. The events occur with great speed in this chart, as will be explained.

After reaching level 204, the dark decay curve flattens out and decays at a relatively slower rate as shown. It is appreciated that if the charged electrophotographic film is never illuminated, the surface potential will follow the curves 206 and 208.

The light decay curve is also composed of two sections, but these do not act like dark decay since the extremely high rate of light decay brings the illuminated surface potential very quickly down to voltages which are substantially below the voltage lever 204. This is due to the extremely important characteristic of the electrophotographic film of the invention which provides for great photoconductive gain. Thus, assuming that the electrophotographic film is completely illuminated by a bright light, within a period of 30 milliseconds the surface voltage will drop along the curve 212 which is practically a straight line to the knee 214 (which is just above zero volts) and thereafter approaches zero asymptotically along the graphic curve 216. In most cases, this latter line 216 is so close to zero as to be almost impractical to measure.

The charge density, and hence the optical density which would result if the photographic film were toned efficiently, is a maximum at the point 202 and a minimum at the knee 214.

Since the electrophotographic film of the invention will be exposed to a pattern of light comprising various gradients, the discharge graph of each increment of the surface will follow a function that can be represented by some curve occurring between the dark and light decay curves, and for purposes of illustration, three such curves are shown and will be explained.

The total exposure of the electrophotographic film is shown in the example as 30 milliseconds, occurring between the times 0.300 second and 0.330 second. It is to be noted that the exposure commences immediately when the maximum charge is reached, and this value, such as the voltage at 202, can be chosen in accordance with the amount of light which is expected to be provided by the scene to be recorded. For low average light the surface charge should be greatest to give the greatest difference between light and dark decay. For high average light the surface charge need not be as great initially.

Continuing with the explanation of the particular example, the three additional increments of the pattern viewed during exposure result in three different surface potential conditions. The first additional increment has the most light but not as much as the maximum and it discharges along the line 217 during the exposure period, being then subjected to darkness from the time 0.330 second onward. At the point 218 the first additional increment will commence to follow the dark decay curve 208, but it will follow that portion of the latter curve which commences at a surface potential reached at the voltage of the point 218. If that voltage, say measured at 14 volts, is picked off from the curve 208, following the level represented by the dot-dashed line 220 to the curve 208 which is obviously well off the chart to the right, and attached to the point 218, it will be represented by the curve 222. The entire curve for the brightest illuminated of the three additional increments is thus represented by 217 and 222.

By the same analysis, the next brightest illuminated of the increments will produce a total curve comprising the sharply falling line 224 turning at the point 226 and following the dark decay curve section below the level 228 added on at 230. As for the least illuminated of the three additional increments, the initial light discharge occurs along the line 232 to the point 234 at the voltage level 236. The portion of the dark decay curve 208 occurring below this voltage can be seen in the chart, occurring as it does to the right of the point 238. This portion of the curve 208 can then be shifted to the left and added at the point 234 to represent the continuation of the discharge of the third additional increment of the electrophotographic film, this latter continuation being designated 240. The curve 206–208 represents no illumination at all.

As indicated in the chart of FIG. 6, toning can commence at the exact moment of exposure completion, that is at the point 0.330 second and continue for a substantial portion of a second — say to the time 1,000 second. This time is determined by the mechanical limitations of moving the toner against the electrophotographic film and the ability of the toner to adhere to the charges remaining.

The resulting optical densities are determined by the amount of charge and hence adhering toner, and for the conditions explained could be, for example, an optical density of 0.01 unit for the increment having total light on the light decay curve 212, 216; an optical density of 1.0 for the next brightest increment on the curve 217,222; an optical density of 1.5 on the next brightest increment on the curve 224,230; an optical density of 2.0 on the least illuminated increment on the curve 232,240; and an optical density of 2.5 on the parts of the electrophotographic film which receive no illumination at all and follow the dark decay curve 206,208.

To complete the comparison between the graphs of FIGS. 5 and 6, one should note that there is no residual voltage for the electrophotographic member of the invention as seen in FIG. 6. Thus the most highly illuminated increments will be without charge and hence dead white. Likewise, the drop-off of charge during the toning period is at most a volt or two and hence the upper limit of the dark decay will be substantially retained to produce dead black on the line 208. The intermediate gradations are also flat in slope giving a continuous gray scale and extremely high quality to the image which is produced. The anisotropy of the photoconductive coating is such that a resolution equal to and better than most fine grain photographic films is realized. A resolution of 1000 lines per millimeter has been achieved.

The charge curve 200 carrying the surface potential above the level 204 will be used in light conditions where it is desired that the electrophotographic film with the photoconductive coating of the invention have the maximum of sensitivity. This would be when the available light for the exposure is a minimum. For better lighting conditions, there is no need to charge the coating so high and hence the charge curve 200 will be stopped at lower potentials, often below the level 204, resulting in lower initial surface potentials. It is typical of all electrophotographic members that the comparatively lower level charges require longer toning time to assure optimum attraction of toner. Toner time can be decreased by electrostatic propulsion of the toner to the charged surface through the use of d.c. potentials established between the toner source and said surface.

Of importance in a consideration of the characteristics of the chart of FIG. 6 are the steepness of the charge curve 202 and the discharge curves 232, 224, 217, and 212 which signify, respectively, high charge acceptance or high speed discharge when subjected to light; the abruptness of the knees 234, 226, 218, and 214 which signify instantaneous cut-off of light decay when exposure is complete and immediate and faithful reversion to the dark decay characteristic; at any intermediate voltage level; the discharge to practically zero surface potential when exposed to maximum light which signifies a dead white background and with the previously mentioned characteristics, a guaranty of a gray scale of almost infinite gradations between dead white and dead black; and the flatness of the dark decay curves 208, 240, 230 and 222 signifying the ability of retain charge and provide more sufficient time for toning and inspection of the toned film.

Reference may now be made to FIGS. 1 to 3 which illustrate an electrophotographic film according to the invention in section, the dimensions being exaggerated and not proportional in order to enable explanation of the several parts of the article. In each case there is a substrate member 16, a photoconductive layer 12 and an intervening conductive or ohmic layer 14. In FIG. 1 contact is made at 18 with the ohmic layer by reason of the photoconductive layer being noncoextensive with said ohmic layer, leaving a portion exposed. The reference numeral 20 signifies a high voltage source and the reference numeral 21 represents a corona generator, the circuit being symbolic of a charging circuit for subjecting the photoconductive thin film layer 12 to a surface charge. A battery is not intended by symbol 20.

In the structure of FIG. 2 a portion of the conductive layer 14 or an independent strip of some conductor such as aluminum is applied along the edge as shown at 22 to facilitate contact with the conductive layer 14. In FIG. 3 this strip takes the form of a member 24 that engages around the edge and a portion of the bottom surface of the substrate 16. This contact strip 22 or 24 provides a good contact with the ohmic or conductive layer 14 and is easily applied in substantial thickness to be wear-resistant. It has been found in many cases that a sharply cut edge such as the right-hand edges of FIGS. 1 and 3 will provide sufficient exposed edge of the ohmic layer 14 to establish electrical contact with a wiper riding such edge. The corona power supply lead would then be connected to the wiper.

The three elements of the basic structure are assembled by sputtering techniques, preferably, carried out in a suitable pressure chamber. The substrate member is preferably cut to proper width before coating and passed through a first pressure chamber in which the ohmic thin film layer 14 is coated on one surface. The invention includes coating large areas and dividing the same to make smaller electrophotographic film members 10. In an alternative process, the source of supply and take-up for the strip of substrate member is contained fully within the chamber. In like manner, the second or photoconductive coating 12 is then applied over the ohmic layer. The contact area 18 or the edges 22 or the lateral members 24 may be applied by vacuum or sputtering techniques and/or by masking, usually before the layers 14 and coating 12 are applied. As will be seen, the characteristics of the photoconductive coating 12 provide an initial enormous resistivity in darkness and a contrasting response to light making it unnecessary to provide any special contact area like 18. This will be discussed in connection with FIG. 9.

PHOTOCONDUCTIVE COATING OR LAYER 12

The photoconductive coating or layer 12 is the most important element of the electrophotographic film because it represents the functional and physical characteristics which make the invention advantageous over the prior art. This coating has great utility in and of itself as will be seen.

The material from which the photoconductive layer or coating is made and which will be described in detail below is one of several known photoconductive compounds. These compounds have been used in the past, but so far as known, have not been successfully incorporated into an electrophotographic member having the properties of the invention. The photoconductive coating of the invention has characteristics which have never been achieved to the degree accomplished. For example, the preferred compound which will be discussed in considerable detail below is cadmium sulfide. This compound has been incorporated in thick photoconductive coatings comminuted and embedded in organic matrices and has even been reactively sputtered in forming wholly inorganic coatings, but nothing in the prior art has achieved the advantageous results which are disclosed and claimed herein. In every case, the formation of photoconductive layers or coatings of the compounds which are mentioned has fallen far short of the achievements of the invention herein and for that reason have not been utilized in the art for the purpose assigned herein.

It should be mentioned herein that the best results which have been achieved thus far have been with cadmium sulfide (CdS) whose characteristics are described in detail. As will be seen, these characteristics make the compound ideally suited for a photoconductive coating for all purposes according to the invention. Its properties make it universal means to construct electrophotographic members and other structures which can take advantage of these properties. The others comprise zinc indium sulfide ($ZnIn_2S_4$), arsenic trisulfide ($As_2S_3$), zinc selenide (ZnSe), zinc sulfide (ZnS), zinc telluride (ZnTe), cadmium selendide (CdSe), cadmium telluride (CdTe), gallium arsenide (GaAs), antimony trisulfide ($Snb_2S$) and perhaps others.

These compounds will be discussed hereinafter, the characteristics mentioned below being specifically those of the cadmium sulfide photoconductive coating. As will be seen, other compounds will have these characteristics for the most part, but to a different degree:

1. The photoconductive layer is wholly inorganic microcrystalline and several thousand Angstroms thick. The only known useful cadmium sulfide coatings have been mixtures with organic binders and matrices, of great thickness and no substantial transparency or flexibility. Prior layers of such materials have for the most part been vacuum deposited. One sputtered layer of the prior art will be described below. The coating 12 of the invention is deliberately made crystalline and thin — being 3500 A to 5000 A in thickness — and is thus extremely flexible and transparent. The conduction of electrons and holes through the coating is enhanced by the manner in which the coating is produced. The crystals are believed to be vertically oriented, that is normal with respect to the surface upon which same are deposited, this resulting from the sputterng process which will be described hereinafter.

It has been found that the "edge effect" characteristic of prior art xerography, for example, is eliminated to a substantial degree in toning the surface of the photoconductive layer 12 of the invention. This "edge effect" consists of the center of a reproduction of an image having a solid pigmented area being light and the edges being dark. The larger the area the more obvious the results of the "edge effect" so that large solid areas that are required to be black throughout come out white in the center. Photographs are impossible to reproduce with even a fraction of their original quality without the use of relatively course screens overlying the original. Negative originals, that is, documents which are illustrated as fine white lines on a black background are incapable of being reproduced with the modern xerographic and electrofax methods because of this "edge effect."

The electrophotographic film of the invention is capable of faithfully reproducing documents and photographs without the use of any intervening screens and without toner biasing. This includes negatives which come out clear and sharp without "edge effect." Toner biasing practically accelerates development and is believed also to eliminate any vestiges of "edge effect" making possible the very highest quality of photoconductive reproduction. As a matter of fact, the quality of which the photoconductive coating 12 is capable is greater than that available from most ordinary photographs today because the latter have grain of macroscopic size while the only limiting factors for the texture of reproduced images on the coating 12 is the size of the toner particles and the size of the crystals comprising the coating. Both of these are typically of the order of a small fraction of a micron.

It is believed that each crystal is oriented perpendicular to the substrate and forms a field domain and functions electrically in the charge and discharge mode as an independent element without communicating with contiguous crystals. The toner particles are thus attracted by myriads of individual fields and not the profound sharp field gradients prevalent in high voltage, noncrystalline photoconductors. This latter condition is the reason for "edge effect" in prior art photoconductive members.

The anisotropy of the coating of the inventon is to an important extent also responsible for the fact that there is no discernible edge effect even when the toning is carried out wihtout a bias. The voltages of the charged and discharged areas of the photoconductive coating are not as high as those of a selenium coating, for example, as can be ascertained by examining FIGS. 5 and 6. The anisotropy means that the surface resistivity of charged and discharged surface areas is the same in the inventon so that the voltage gradients are not enhanced by discharge.

As an example of the flexibility which is achieved, when the photoconductive and ohmic layers of the invention are deposited upon a sheet of flexible polyester 0.005 inch in thickness, the electrophotographic film of the invention can be wrapped around a cylinder 0.25 inch in diameter without cracking or crazing even though the photoconductive layer is crystalline. The ability to be wrapped around cylinders a fraction of an inch in diameter is representative of the ability of transporting the electrophotographic film through handling and display machinery without problem.

Another characteristic which is related to the fact that the layer 12 is inorganic, thin and crystalline in character is its extremely density and hardness. The surface is mentioned above as being hard as glass. Abrasion resistance is important in handling the film since it obviates scratches, scores and the like which can cause loss of detail and data, especially in fine subject matter. In the manufacture of the electrophotographic film no difficulties are met where it is necessary frictionally to move the same by engagement of the surface by friction rollers and the like.

The abrasion resistance of the photoconductive coating 12 is believed related to the density of the compound occasioned by the manner in which it is deposited. This radically improves the electrical properties as well, over known coatings.

The material is electrically anisotropic and will, at least for a substantial period of time (see FIG. 6), retain a nonuniform charge pattern applied thereto or produced therein as required in its utilization electrophotograhically and as a photoconductor. It also means that the finest resolution pattern can be accurately and faithfully produced in the latent image. 2. The coating 12 has a high photoelectric gain characteristic (as defined hereinabove). Thus, instead of the large number of photons needed to create a hole-electron pair in the photoconductors of the prior art, photon causes the combination of more than one hole electron pair.

The high gain characteristic is of importance because it increases the sensitivity of the electrophotographic film of the invention to a point where it is commensurate with the sensitivities of most high speed photographic films, but not necessarily with the same characteristic loss of detail due to large grain. There is no grain in the material of the invention, the crystalline structure being microscopic.

The absorption of photons is needed to cause the discharge of the photoconductive coating and to create hole-electron pairs. This latter is perhaps a better way of putting it since the ohmic layer or conductive member in the prior art is needed to achieve discharge while in the case of the invention herein it is not needed. The coating should be thick enough to facilitate absorption of a sufficient percentage of visible light to cause a rapid discharge, yet thin enough to be transparent, flexible, and of significant resistivity to retain high resolution latent images. This will be understood to furnish the reason why the coating does not readily absorb red light (see FIG. 7) which passes easily through materials of this nature. The gain is required to be increased for red light and this can be done by doping as explained. On the other hand, for many applications, especially that of an electrophotographic film which is to be used optically and which is to be manipulated by camera drive mechanisms, for example, it is desired to have the film as thin as possible for flexibility and transparent to be able to project light through it.

The thickness of the layer 12 should be such that there is sufficient thickness to provide the desired light absorptivity and still provide the transparency, flexibility and abrasion resistance qualities which are desired in an electrophotographic film. As mentioned in connection with the prior art photoconductive coatings, the speed of the film will go up with thickness but the gain, once a maximum has been achieved with an optimum thickness, remains constant no matter how thick the coating. What one can do is to deposit a thickness of the layer 12 which gives the desired absorption of light with the minimum of practical thickness to give the best gain and greatest flexibility. This can be done experimentally by depositing a small amount and making necessary measurements, continuing until the desired characteristics have been achieved. In the practical device which involves the use of a roll of substrate being coated, the experimental coatings can readily be made along the same roll by simply varying the speed of rotation of the roller or drum over which the substrate is being passed. The same deposit conditions, but for thickness, are thus achieved in a single long strip of the electrophotographic member at plural locations along the length.

In determining the best thickness of the coating 12, one important factor is economy. On this account, the coating should be as thin as possible for low cost.

The requirements of light absorption must be met, in any event. With the invention it is possible to do so with a photoconductive layer that has substantially more than unity gain and excellent abrasion resistance.

3. The photoconductive coating 12 has a high dark resistivity which promotes charge acceptance and charge retention. The cadmium sulfide coating which is the preferred photoconductive coating is inherently n-type and in its purest form, as deposited in accordance with the invention, has a dark resistivity of $10^{12}$ to $10^{14}$ ohm-centimeters. Its light resistivity is about $10^{8}$ ohm-centimeters. Its energy gap is about 2.45 eV. These measures of resistivity are dynamic. Static measurements of resistivity show much lower values and are made by known methods of bonding electrodes to the surface or surfaces of the photoconductive coating, applying d.c. voltage, measuring current and computing the values from the geometry. The dark resistivity measurements are made in darkness. It is pointed out, however, that this is done without a charge on the photoconductive layer. Since the photoconductive layer of the invention is very thin, when the charge is applied to the surface it enters such surface and drives free carriers toward the ohmic layer thus forming a depletion layer extending throughout the thickness of the coating. Its effect is felt to a great extent through the photoconductive layer. Absent such carriers, during the period after charging, discharge is inhibited, and the dark resistivity should be increased. Dynamic measurement of dark resistivity can be effected by bombardment with electron beams in a vacuum and measuring the current and voltage when done in darkness.

The reference hereinafter, both in the specification and claims to resistivities will be considered static. As stated, the dark resistivity is $10^{12}$ to $10^{14}$ ohm-centimeters and higher.

The high dark and lateral resistivity of the coating 12 represents an excellent insulating material; the high ratio of dark to light resistivity transversely is of the order of $10^5$ and represents a radical change in the resistance. This coating is one which had a thickness of about 3500 A and an optical transmissivity of between 70% and 85%. The conductivity increase transversely when illuminated is related to the sensitivity of the coating.

Zinc indium sulfide, one of the other compounds mentioned, has a dark resistivity of about the same order as that of the cadmium sulfide with a light resistivity somewhat higher so that the ratio is not as great. The energy gap of zinc indium sulfide is about 2.3. Its performance as a photoconductive coating is not as good as that of cadmium sulfide, at least in the electrophotographic films that were tested using the zinc indium sulfide as the photoconductive layer.

Although not required, cadmium sulfide can be doped with known dopants, such as, for example, minute quantities of copper, iodine and the like, to provide additional carriers of electrons. This should render the coating even more n-type than the pure cadmium sulfide and give a greater gain. Others of the materials may also be doped for the same purpose.

It must be understood that the proportions of the elements which make up the photoconductive layer must be stoichiometrically correct, this being achieved by control of the conditions of deposit.

As mentioned, the sputtering of films of cadmium sulfide and other compounds has been accomplished in the prior art, but so far as known, the properties of the cadmium sulfide coating of the invention have not been achieved. In a paper published in Vacuum Symposium Transactions, 1963, pages 335 to 338, there is a report of the sputtering of sulfide films be reactive sputtering in an atmosphere containing hydrogen sulfide. The maximum dark resistivity achieved by this conventional sputtering method is claimed to be $10^6$ to $10^8$ ohm-centimeters. The reference was in a nonanalogous art in that the subject matter was photovoltaic cells, although the photoconductive coating per se of the invention herein could be used for such cells as well. In that article, the cadmium sulfide coating was discussed as a laboratory exercise rather than as a commercially utilitarian accomplishment. So far as known, no products of this kind are known to exist. The experiments described related to efforts to improve the properties of the sulfide coatings by the use of different impurities. It is again pointed out that the cadmium sulfide of the coating of the invention is quite pure; that it has a static dark resistivity which is $10^4$ to $10^8$ times greater than that found by the authors of that article even assuming pure CdS; that it has the gain, charge acceptance, speed and other properties which enable it to be put to practical and non-contemplated use. Certainly the Lakshmanan et al. article is useless for electrophotography.

4. The coating of the invention which is made from cadmium sulfide is practically panchromatic. Other compounds have differing spectral response.

The cadmium sulfide coating 12 has a peak response in the 5000 Angstrom area which makes the coating desirable for a broad variety of electrophotographic, indeed photographic applications. It is desired to have most radiation of a type that it is desired to record be capable of producing images on the electrophotographic film or on the photoconductive coating of the invention. All of the ordinary visible light is included along with X-rays and ultra violet. The film is insensitive to infra red radiation.

The coating of the invention is a material which provides more than the properties which have been known and expected of the same materials as taught by the prior art. Included in these properties is the spectral response, this being exemplified in the curves of FIG. 7.

Figure 7:
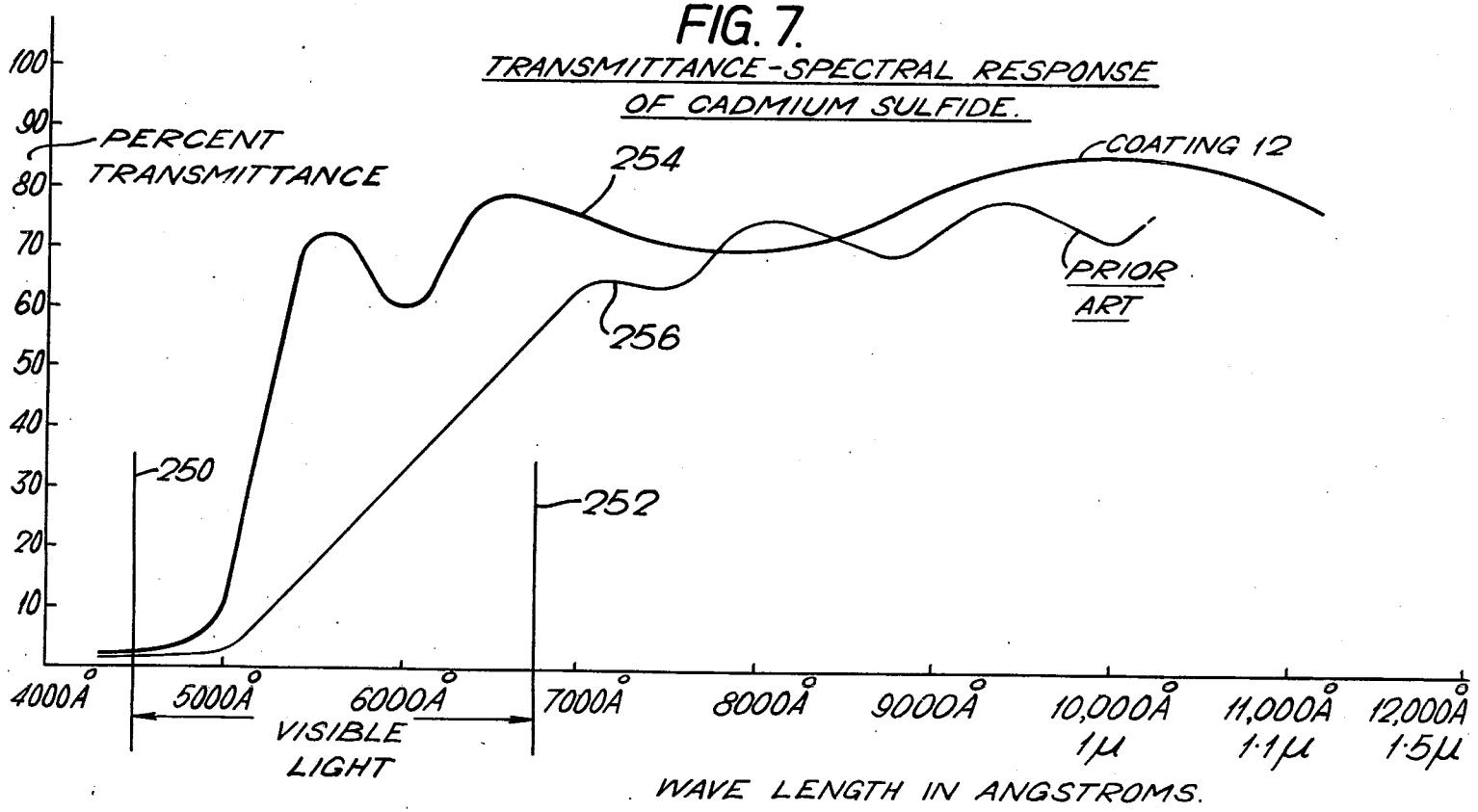
FIG. 7 is a chart showing the spectral response of a thin film coating of cadmium sulfide made in accordance with the invention compared with that of a photoconductive coating of cadmium sulfide sputtered by conventional methods.

The graph shown in FIG. 7 illustrates the spectral response versus transmittance of a prior art coating of cadmium sulfide and a coating 12 according to the inention. The vertical axis is percentage transmittance from zero to 100% and the horizontal axis is in Angstroms. The visible portion of the spectrum is marked by the lines 250 and 252. The curve 254 represents the response of a photoconductive coating of cadmium sulfide deposited in accordance with the invention and having a thickness measured by interferometric methods as 4120 Angstroms. The curve 256 is a prior art curve given in the above-identified reference in Vacuum Symposium Transactions for a layer of cadmium sulfide deposited by conventional sputtering methods. The thickness was not specifically given but was stated to by typical at 5000 Angstroms.

It is noted that the transmittance of the cadmium sulfide coating of the invention is everywhere better than that of the prior art coating except in a small area in the vicinity of 8000 Angstroms. This is outside of the visible range and into the higher wave lengths. The most important aspect of the comparison is that the photoconductive coating 12 of cadmium sulfide according to the invention has a high relatively flat response throughout all of the visible spectrum while the same material but deposited according to the prior art methods has a distorted response. The latter is high in the infrared regions and low in the blue green regions.

Thus, the cadmium sulfide photoconductive coating of the invention can be said truly to be panchromatic. This may not hold for the other compounds which will exhibit varying responses, peaking in different regions. Improvement in response may be secured by using a coating of more than one material.

The spectral response of the cadmium sulfide and the other compounds suggested may be improved with doping along with improvement in sensitivity, but the basic teachings of the invention provide a photoconductive coating which per se is vastly superior to the prior art coatings whether doped or not.

5. The photoconductive coating of the invention is easily deposited in the special manner which gives it its unusual properties. This guarantees uniform deposit and high speed controlled production. It is interesting to note that the prior art methods of deposit, even where sputtering is used, take inordinate lengths of time because thick coatings are used. Since the coating of the invention is so thin, less time is required and this yields a superior article, from the standpoint of electrical, optical and physical properties.

The photoconductive coating 12 in all cases is deposited by R.F. sputtering in a vacuum chamber. All of the materials which go to make up the coating, whether dopants are included or not, are introduced into the vacuum chamber. There are no pastes or resins to be handled. The compound materials are introduced by way of the consumable target made out of the compound, the dopants, if any, being supplied by gases or sublimed compounds introduced into the atmosphere of the vessel after the process has been started. Stoichiometrically correct proportions are controlled by techniques of the invention to result in a substantially perfect and uniform product.

The sputtering of the photoconductive layer 12 is a critical part of the invention in that, so far as known, the vast improvement over the prior art is achieved by establishing a second dark space. This can be done by connecting the radio frequency circuit of the sputtering apparatus in a bias arrangement. The result is a thin film coating of the photoconductive material which is extremely dense. It is believed that the bias which is an important manufacturing parameter, helps bring about the results of the invention. In any event, by whatever theory, the results are unexpected. Details will be discussed hereinafter.

The characteristics which have been described above are not exclusive, but are believed to be the most important. Many other advantages occur concurrently, either as a result of the characteristics which have been mentioned or in addition thereto. For example, the advantages which flow from the characteristics which make the electrophotographic film useful as high speed photographic member, rivalling in certain respects photographic film and exceeding it in others enhance its suitability for use as electrophotographic film itself. Some of the advantages over other electrophotographic members derive from the coating being wholly inorganic. For instance, there is no problem with moisture, light, temperature extremes and even more important, fatigue. The selenium drums of the prior art apparatus lose their ability to accept charge and retain it after long periods of use due to light fatigue and must be changed from time to time.

The coating per se need not be applied to a substrate member which is thin, transparent and flexible. It has use, for example, when applied to a glass substrate and finds use in making lecture slides, or glass electrophotographic articles. It could be applied directly on metal discs, cylinders and the like for recording and storage purposes. It can be used in the manufacture of economical circuit components energized by light and the like. One of the most important uses, however, comprises its use to substitute for a photographic film as explained herein.

OHMIC LAYER 14

The ohmic layer 14 is a conductive layer that is deposited on the substrate member 16 before the deposition of the photoconductive layer 12. Its primary purpose is to facilitate the charging of the photoconductive layer 12. Under circumstances that a p-type coating or layer 12 is used, the ohmic layer 14 may assist in discharge. It also may serve to assist in bonding the photoconductive layer to the substrate member. In the use of the coating 12 to produce an electrophotographic film, the layer 14 is transparent.

This ohmic layer is very much thinner than the photoconductive layer 12, preferably being of the order of 500 Angstroms. This thickness will not interfere with the transparency or flexibility of the final electrophotographic film product. It forms the interface between the photoconductive layer 12 and the substrate member 16. It functions as one element of the capacitive circuit during charging of the surface of the photoconductor.

A purity grade of semiconductor indium oxide either alone or combined with a small percentage (10%) of very pure tin oxide is a suitable material for use as the ohmic layer 14. It is easily bonded to aluminum edges or conducting strips. It is also easily and preferably applied by sputtering techniques in the same apparatus as used to apply the photoconductive layer. This latter is the method used to make the practical embodiments of the invention. Vacuum or vapor deposition may be used but will probably not provide as dense and smooth a layer nor one which is so well-bonded to the substrate.

A metallic or other layer of the order of 100 Angstroms thick may be deposited directly upon the substrate between the ohmic layer 14 and the substrate 16 to improve the adhesive affinity of substrate 16 and the overlying inorganic ohmic and photoconductive layers 14 and 12, but this generally is not required. Such a layer could be titanium metal or even cadmium sulfide and is indicated at 15 in FIG. 4. It is deposited by sputtering. If metal, it becomes a part of the ohmic layer 14; if cadmium sulfide, it becomes effectively a part of the substrate 16. The latter has no discernible effect on total transparency, the former may decrease it. Circumstances will dictate usage, but cadmium sulfide is preferred. Some of the best practical examples of electrophotographic films made according to the invention included cadmium sulfide R.F. sputtered on the substrate 16 in a layer estimated as 50 to 200 A thick (not readily measurable, even by interferometric techniques); a layer of indium oxide 14 R.F. sputtered on the layer 15 of thickness of the order of 300 A; and the R.F. sputtered layer 12 described. Whether the improved quality was due to the enhanced bond or some characteristics of the cadmium sulfide is not known. It is believed that the bias which is an important manufacturing parameter, helps bring about the results of the invention.

SUBSTRATE MEMBER 16

The substrate member 16 is the carrier or mechanical support for the photoconductive layer 12 and the ohmic layer 14. The properties of the preferred substrate member 16 have been alluded to above, but have not been specifically detailed. The mechanical properties are flexibility, strength, transparency, ability to adhere to the deposited layers and of great importance – stability. The stability refers to dimensional stability, stability in retaining thickness, stability in resisting any changes which may occur due to being subjected to the temperature and electrical phenomena which occur within the pressure vessel during the depositing processes. Resistance to abrasion is a good property to include in choosing the substrate material.

Polyester sheeting of 0.005 inch thickness has been mentioned above as one example of substrate that has been satisfactory. This material is an organic polymer.

Of excellent characteristics is such material made by the E. I. duPont de Nemours company and sold under the trademark "MYLAR." This material is sold usually with conditions of internal stress that are inherent due to its method of manufacture. Such stresses are preferably required to be removed prior to use, the process of doing so being referred to as normalization. This can be done by subjecting the film to a temperature of about 190° Celsius for a period of about 30 minutes. Such steps are known.

The substrate material should not have any adverse plasticizer contamination effects, and these can be eliminated by outgassing the same in suitable chambers. Likewise, the sheeting should be perfectly clean.

As mentioned, other substrates may be used to achieve other uses of the photoconductive coating if flexibility and/or transparency are of no importance.

The above descriptions comprise the details concerning the three principal elements of the electrophotographic film 10 of the invention, there following a discussion of the manner in which the same is manufactured.

Commencing with the fully conditioned substrate member 16, the first step of manufacture consists of depositing the ohmic layer 14 (which may comprise more than one lamina of conductive material including a metal bonding layer 15, for example). If a transparent and/or photoconductive bonding layer 15 is deposited, this is done before the deposit of the ohmic layer 14 according to the same technique used to deposit layer 12 as described below.

Considering a preferred method of deposit, a pressure chamber is used and the deposits are carried out by sputtering with ionized gas so-called plasma vapor in a radio frequency electric field. The substrate is placed upon an anode or may be led over an anode in the case of production methods, the anode being of stainless steel and suitably heated to about 150° Celsius with water or other means. In small sputtering apparatus, the anode may be heated up to as much as 155° Celsius. In a preferred structure the substrate is in the form of a long strip and is led over the anode which could be in the form of a roller or drum. Small substrate members, say of the order of 5 centimeters (about 2 inches) square may be placed upon the anode of known sputtering chambers for laboratory work or low quantity production.

The cathode or target of such apparatus is formed of the material from which the layer is to be made. Other elements can be added by introduction into the chamber. In one example carried out for testing purposes the cathode was semiconductor grade indium oxide. In another, it was an alloy of 90% $In_2O_3$ and 10% $SnO_2$. This was for the deposit of the ohmic layer 14. The cathode is spaced from the anode in accordance with the physical characteristics of the particular chamber, considering the geometry, the voltages to be used, etc. The chamber in the example was pumped down to near the $10^{-7}$ torr pressure range. This, of course, is a substantial vacuum. Then ultrapure argon, that is, containing less than 10 ppm $H_2O$ and $N_2$ was admitted to the sputtering chamber through a servo-leak valve until a pressure of about 20 millitorr is achieved.

At a suitable point, the radio frequency field is established to ionize the argon and to produce ions which bombard the target or cathode, knocking the molecules of indium oxide (and tin oxide, if used) out of the target, the argon ions comprise the plasma vapor between the cathode and anode. The knocked out molecules move toward the anode with high energy there to be deposited upon the substrate member.

This sputtering is carried out at a rate which is determined by the conditions within the chamber, typically about 15 to 40 Angstroms per second for a commercial version using approximately 1 to 2 square feet of target area. Thickness is monitored by optical means known in the art until a thickness of about 500 Angstroms is reached.

The substrate member is now removed from the chamber and passed into or placed within another chamber in production. If the process is a laboratory process or in very small production, the same chamber may be used but the cathode or target must be changed. Likewise stringent steps must be taken to remove all possible residual material to avoid contamination. Careful shielding of the target or targets and the plasma can minimize contamination in the chamber.

In any event, the substrate member 16 with its first coating of the ohmic layer 14, (and a previous underlying bonding coating 15, if this was applied) in the case of the example being described being indium oxide, alone or combined with tin oxide, is again mounted on an anode carrier or led over a rotating anode or the like.

For a photoconductive layer of cadmium sulfide the cathode or target will be made out of cadmium sulfide. The pressure is first dropped to $10^{-6}$ torr before being adjusted to 10 to 20 millitorr with later admitted argon gas and hydrogen sulfide. The hydrogen sulfide serves as a background gas to counterbalance the vapor pressure of sulfur. This prevents decomposition of the cadmium sulfide and thus controls stoichiometry of the coating deposited on the ohmic layer. It will be appreciated that in both depositing procedures the rear surface of the substrate member 16 is blocked or masked to prevent any deposit thereon in normal processes. A first dark space induced by a shield around the target inhibits side and back deposits. In the case that a cadmium sulfide cathode is used, the amount of hydrogen sulfide admitted is about 500 to 15,000 ppm in argon. The final pressure in the chamber was between 7 and 15 millitorr.

A small amount of copper in the form of sublimated copper chloride may be admitted into the sputtering chamber, this being effected by keeping the copper salt in an evacuated vessel which communicates with the sputtering chamber through a control valve. Copper is the dopant in this case, increasing the trapping levels in the inherently n-type cadmium sulfide. Hydrogen iodide may alternatively be used to provide iodine dopant to give additional trapping levels in the cadmium sulfide deposit.

Other methods of doping are ion implantation, diffusion migration and the like.

The application of the radio frequency high voltage creates the necessary plasma to effect deposit of the cadmium sulfide onto the ohmic layer to form the photoconductive layer 12. The rate of deposit in tests conducted was about 6 to 15 Angstroms per second. Greater rates as mentioned above can be achieved in commercial equipment. Dopants if used are admitted in small controlled quantities sufficient to dope the cadmium sulfide on the ohmic layer. Most practical examples were totally pure. The sputtering is continued until the thickness of the coating 12 reaches 3000 to 3500 Angstroms. In the test made the layer had a microcrystalline structure with the mean diameter of the crystals being about 0.1 micron or about one-third the thickness of the layer itself.

As previously mentioned, one of the most important aspects of the invention revolves around the special method of sputtering which is used. While used for both the deposit of the ohmic layer 14 and the photoconductive coating 12, the most important application of this method is in sputtering the latter. This method is termed generally controlled "biasing".

In the method of sputtering which is conventional, the cathode or target is connected to the "high" side of the output of the radio frequency generator, normally through a matching network, and the anode or substrate support is connected to ground. The radio frequency energy ionizes the argon gas which is introduced into the chamber and there is a plasma formed between the target and anode, there being a first dark space of relatively short dimension just at the surface of the target. Atoms of molecules of the target are literally knocked out of the target by the ions of the argon gas and are driven across the intervening space through the plasma and impinge against an article that overlies the anode. This would be a substrate member and the particles themselves together with whatever dopant may have been introduced into the chamber are deposited onto the substrate.

It has been discovered that by biasing the radio frequency circuit in the manner to be described the molecules of deposited material are deposited in a particularly structured manner and exceptional never achieved or predicted electrical properties result therefrom. This biasing arrangement produces a second dark space immediately above the anode. The arrangement is as described in connection with the diagram of FIG. 8.

In FIG. 8 at the left-hand side of the diagram there is illustrated an R.F. generator 260 connected to a matching network and plasma generator 262 through a transmission line 264. The matching network 262 may be located close to the vacuum chamber (not shown) whose target 266 and anode 268 are shown in simple schematic at the right. The network 262 contains an inductor L and a tunable capacitor C1 in series with the high voltage lead 270, the output connection to the target 266 being shown at 272.

The shunt capacitor C2 is also tunable and its terminal closest to ground, but nevertheless above ground, is connected by the lead 274 to the anode 268. The terminal 276 is thus located at an instantaneous voltage above ground, which in the practical apparatus used to coat the cadmium sulfide coating 12 of the invention, was substantially less than −200 volts. (The cathode is effectively at a negative voltage relative to ground). The high voltage terminal 272 was at a potential of about 2 kilovolts. The cathode was shielded on all sides but it outer surface by a closely arranged cap or member 278 of conforming configuration connected to ground. The tunable condenser C3 was connected from the terminal 276 to ground, in effect, being connected to the shield 278. The condensers C2 and C3 were in effect variable reactances enabling the adjustment of the division of voltage between the components 266, 268 and 278.

This biasing setup provided the two dark spaces between the plasma and the electrodes. This is shown schematically in FIG. 8, the plasma being shaded at 280, the normal dark space being shown at 282 and the new or second dark space produced by the bias being shown at 284.

The photoconductive coating 12 of the invention is advantageously used in the construction of an electrophotographic film 10. When cadmium sulfide is used, the article has a yellowish cast which varies slightly with thickness of the coating. The thicker coatings were slightly darker, but the variation of thickness between 3000 A and 5000 A gave excellent results without taking the transmissivity of light outside of the usable range as described. Other of the materials will have different colors, but nevertheless the most of them are transparent to visible light within the range needed. For example, zinc indium sulfide coatings are bluish-yellow. The thickness of the ohmic layer 14 could be as much as 1500 A depending upon the thickness of the coating 12.

In use, the electrophotographic film is charged to a high potential by means of corona or other ionizing apparatus as explained in connection with FIG. 6. Exposure is effected very quickly, high on the dark decay curve. Thus, the article is charged to the point 202 on the curve 200 and then exposed for a fraction of a second thereafter.

The proper timing is accomplished by monitoring with an exposure meter so that the charge builds up to an optimum value for the particular light condition under which the electrophotographic film is to be exposed, this being accomplished automatically. Reference should be had to application Ser. Nos. 389,149 and 397,309, now U.S. Pat. No. 3,864,035 for the details of this technique and structure.

It will be appreciated that the preferred method of charging the electrophotographic film 10 features a rapid build-up of charge carriers at the surface. In conventional xerography or electrofax the medium or plate is slowly charged to saturation, that is, to the point where the charge leaking off the medium is equal to the charge building up. This is shown on the curve 34 of FIG. 5 at about the point 36. In the case of the electrophotographic film 10 of the invention, the medium is charged very quickly and for conditions of low light intensity this is to the maximum charge level point 202. Immediately after the desired surface potential is reached the film is exposed to. take advantage of the high volume achieved and the gain characteristics.

After the electrophotographic film 10 of the invention has been exposed, toner is applied to the surface of the photoconductive layer very rapidly and uniformly. The toner is preferably applied in the presence of a bias voltage in close proximity to the film surface to accelerate the toner particles toward the surface and to assist the inherent crystalline field effect to provide an even particle distribution. The use of toner bias for high resolution without edge effect is not essential to the invention. Conventional fine particle carbon toners can be used for black and white transparencies. Colored resins may also be used. Toners which are self-adhering are useful with the film 10.

Finally, excess toner may be removed from the surface if necessary and the remaining toner fused to the surface of the film by a uniform flash of infrared radiation or may be transferred to another member. The entire process is completed before the surface voltage on the electrophotographic film 10 dissipates. This total time is of the order of a second, the critical charge and expose periods together occupying less than half a second. The toner thereafter permanently adheres to the surface 28 as indicated at 26 in FIG. 4.

In the process of using the electrophotographic film of the invention, once the toner has been applied, and before it is fused, the distribution thereof is fixed. Accordingly, the charge decay thereafter will not materially affect the now visible image represented by the positions of the toner particles. Modern liquid toners will physically adhere. No high speed apparatus is essential for fusing the toner immediately after it has been distributed (and the excess removed if the type of toner requires this). This can be done in a reasonable length of time. There is another advantage which is achieved however, especially in the case of use of the electrophotographic film in experimental work. Prior to fusing the toner, the operator can examine the same carefully to see whether the desired image has been achieved. If not satisfied, he may change lighting conditions, time of exposure, adjust focus, etc., in order to get a better "picture." As for the toner image achieved from the previous exposure, he merely rubs the same off the film by any simple means such as a swab or cloth, leaving the surface clean. Accordingly, there is no waste of electrophotographic film, and no waiting or time lost in order to achieve the desired results. Commercial photographers are required to take multiple pictures to get the "right one" since they must await development. The loss of time has to some extent been alleviated by the "Polaroid" type of camera, but the expense of multiple exposures has not been materially decreased. The invention with its "wipe away" feature accomplishes both results. The high resistance to abrasion makes this feasible.

The resulting electrophotographic film 10 is a transparency, suitable for projection or for use in making prints. The image is characterized by a high degress of resolution, making the article and process highly advantageous in producing microimages. It has excellent contrast and exceptionally clean background. When projected on a greatly enlarged scale for viewing or copying purposes, the resultant enlarged image still has good detail and is relatively free of imperfections in the while or light areas.

Several comments should be made with respect to some of the aspects of the invention which should be considered in practicing the same and achieving the most optimum of results. These relate to the compounds which have been mentioned above; the conditions of sputtering; and some general considerations.

First, with respect to the compounds, although all of them are known photoconductors the principles of the invention have been proven, most experimentation and all of the practical work has been done only with cadmium sulfide. It is appreciated that the parameters involved in sputtering are manifold and that all of these can be varied in experimentation with the materials used to form the coating 12. This would require a considerable length of time and substantial expenses. According to the disclosure herein, cadmium sulfide can be and has been used to produce commercial grade coatings and electrophotographic films. As for the other compounds, zinc indium sulfide, arsenic trisulfide and zinc sulfide have been used to produce coatings for electrophotographic films which have produced good results, although not as good as the cadmium sulfide. The remaining compounds mentioned have produced results indicating candidacy for coatings according to the invention, but more experimental work thereon is required.

The principal problems with sputtering compounds of these types in laboratory machines lie in contamination. These problems are in addition to the need to find the optimum parameters. Contamination arises in three areas: (1) most important in the sputtering apparatus itself, (2) next in the manufacture of the target, and (3) finally in the handling of the target. Running experimental tests with commercial machines using large (1 square foot to 3 and more square feet of area) targets is most difficult.

The sputtering apparatus for investigating compounds must be immaculately clean. It is preferable to use each particular piece of equipment for the sputtering of only one compound since the remnants of other sputtering projects using other compounds are extremely difficult to cleanse from the apparatus. It can be appreciated that since even laboratory sputtering devices are extremely expensive the number of equipments needed for a long term experimental program designed to provide the exact conditions needed to achieve coatings of even a few compounds will require great expenditures.

Purity of the targets is required in order to achieve proper stoichiometry of the deposited coating, aside from the distortion of results that comes from the inclusion of unknown contaminants. This problem is exacerbated by the fact that a few parts per million of any contaminant can change the entire electrical activity to be expected from the compound. Cathodic targets of the compounds mentioned are normally available from highly specialized sources. Manufacturers of this type of material are reluctant to establish and maintain the controls needed to provide the targets, let alone manufacture them. These targets are compressed, sintered, or made by other methods and must be shaped and sized for the particular sputtering equipment.

Handling of the targets by the technicians can contaminate them through foreign substances on the handling tools, on the hands or bodies of the technicians and even through gases which may be in the atmosphere.

Accordingly, no inference should be drawn that all of the compounds mentioned have been successfully coated. The purpose of naming them is to point out that according to all indications, all of them should be capable of being sputtered according to the invention to form photoconductive coatings of varying properties, but nevertheless substantially better than the photoconductive members previously made with these compounds. So far as known, none, as used in the prior art has been able rapidly to accept and retain a charge for a sufficient time needed to expose and tone it. In other words, these compounds as used in the prior art have not had a sufficient ratio between dark and light decay characteristics to provide any reasonable charge contrast upon exposure. Charge acceptance and retention has also been deficient for toning.

Mention has been made of the temperature conditions of sputtering. Cooling of the anode has been mentioned. It has been found that in certain instances, especially in the experimental sputtering of the preferred coating cadmium sulfide, that the anode is best maintained at an elevated temperature. This may be due to the fact that all of the coating was done in small sputtering devices. Temperatures of the anode ranged from 100° Celsius to 140° Celsius giving excellent coatings. Cooler anodes often resulted in coatings which were inferior, it being believed that the increased temperatures relieved stress in the crystalline coating as it was formed. In larger equipments this is not necessarily required, but the temperatures of the cathode should be adjusted for the type and volume of materials being handled. Incidentally, this is still another parameter that must be taken into consideration in sputtering the coating of the invention.

In FIGS. 1 through 4 means are shown to enable a contact or connection to be made to the ohmic layer 14. The primary purpose for this connection is to furnish the capacitivelike arrangement in cooperation with the corona power source 21 to enable the charging of the photoconductive surface in darkness. The photoconductive coating 12 of the preferred embodiments provides trapping and/or combination centers where the hole-electron pairs that are produced by impinging photons during exposure can combine to provide for the discharge which is represented by loss of charge at the surface. The extent to which this occurs in the invention is so great that there is no need for a grounded connection to the ohmic layer once the electrophotographic film 10 has been charged. The n-type characteristic of the coating 12 produces this phenomena in the preferred embodiments, such coating being cadmium sulfide.

The need for a grounded connection to assist in discharge is characteristic of the prior art, since the prior art coatings are not as efficient and as a rule are p-type. In the case any compounds used according to the invention are made as p-type compounds, it is likely that a grounding connection will be needed for aid in discharge.

It has been found that no special effort or structures are required for use in establishing the connection to the ohmic layer for achieving charge. The edge of the film 10 may be raw with a wiper engaging the same or contacting the film in almost any casual manner.

The characteristics of the film 10 are brought out by reference to a novel arrangement for establishing contact with the ohmic layer 14 in FIG. 9, either for charging or discharging or both. The electrophotographic film 10 constructed in accordance with the invention has a substrate member 16, an ohmic layer 14 and a photoconductive coating 12. There is a metal clamp or frame member 70 grounded and in direct contact with the surface 28 of the coating 12.

To charge the film 10, all that is necessary is to illuminate the coating in the vicinity of the member 70 while the corona voltage is applied. The light resistivity of the coating 12 is so radically reduced in light that it is as though there were a direct connection with the ohmic coating 14 and since the corona power supply is grounded, the to electrical connection is completed. There is no need to keep the coating in the vicinity of the member 70 illuminated during discharge unless the coating is p-type.

There follows an example of the method of making an optimum quality photoconductive coating of cadmium sulfide:

In a small semi-experimental sputtering machine, the R.F. power input was 200 watts; the potential to ground was 2 KV; the bias was 20 volts; the frequency was 13.5 mhz. The target was ultra pure (99.99998%) cadmium sulfide, hotpressed and sintered, 6 inches in diameter, capable of ringing when struck. The grounded shield surrounded the target on all sides except that surface facing the anode and was spaced about ¼ inch from the target. The target was recessed into the shield a fraction of an inch. The substrate was 1 ½ inches from the target. The anode was maintained at a temperature of 155° Celsius. The atmosphere was highest purity grade argon diluted with 15,000 ppm of pure $H_2S$ gas to produce a pressure of about 10 millitorr. A secondary dark space was clearly visible between the plasma and anode. Deposit was carried on at about 6 or 7 Angstroms per second and a 3,000 Angstrom coating was achieved. (This rate of deposit is capable of being multiplied in large commercial sputtering machines).

Variations are capable of being made in the details of the invention and the methods and processes described without departing from the spirit or scope thereof as defined in the claims which follow. It is emphasized that the details which have been given are merely exemplary and not to be considered as limiting.

What it is desired to secure by Letters Patent of the United States is:

1. In an electrophotographic article in which substrate means carry thin film coatings at least one of which is a thin film coating of a photoconductive material less than 1 micron in thickness, means contiguous to the coating to facilitate uniform charging thereof before exposure; the invention comprising, said coating being very dense, wholly inorganic, microcrystalline, the crystals of said coating being generally uniformly oriented vertically relative to the surface of the substrate means, substantially free of effective barrier layers between the crystals, the coating having light transmissivity of at least 70 percent, having a dark resistivity of at least $10^{12}$ ohm-centimeters and a ratio between dark and light resistivity of at least about $10^4$ and being electrically anisotropic whereby said coating is capable of accepting a rapid charge and retaining same sufficient to enable toning.

2. The article as claimed in claim 1 in which said substrate means are transparent.

3. The article as claimed in claim 1 in which the means to facilitate uniform charging of the coating comprise a thin film layer of ohmic material sandwiched between the coating and substrate means.

4. The article as claimed in claim 1 in which said substrate means, the coating and the means to facilitate charging are flexible.

5. The article as claimed in claim 1 in which said substrate means comprise a transparent member; in which said thin film coating material is a semiconductor and is characterized by no greater than 85 percent light transmission; and in which the means to facilitate charging comprise a thin layer of ohmic material between said substrate means and said coating.

6. The article as claimed in claim 1 in which said substrate means comprise a flexible, transparent, organic polymer sheeting member; in which the light transmissivity of the coating is no greater than 85 percent, in which said coating is a semiconductor and flexible; and in which the means to facilitate charging comprise a thin layer of ohmic material between said substrate means and said thin film coating, said thin layer also being flexible.

7. An article as claimed in claim 1 in which said thin film coating material is dominantly cadmium sulfide.

8. An article as claimed in claim 2 in which said thin film coating material is dominantly cadmium sulfide.

9. An article as claimed in claim 3 in which said thin film coating material is dominantly cadmium sulfide.

10. An article as claimed in claim 4 in which said thin film coating material is dominantly cadmium sulfide.

11. An article as claimed in claim 5 in which said thin film coating material is dominantly cadmium sulfide.

12. An article as claimed in claim 5 in which the semiconductor is n-type.

13. An article as claimed in claim 6 in which the semiconductor is n-type.

14. An article as claimed in claim 3 in which said thin-film coating and said thin film layer are together less than around 5000 Angstroms thick.

15. An article as claimed in claim 5 in which said thin film coating and said thin film layer are together less than around 5000 Angstroms thick.

16. An article as claimed in claim 6 in which said thin film coating and said thin film layer are together less than around 5000 Angstroms thick.

17. An article as claimed in claim 1 in which said thin film coating is at least primarily zinc indium sulfide.

18. An article as claimed in claim 2 in which said thin film coating is at least primarily zinc indium sulfide.

19. An article as claimed in claim 3 in which said thin film coating is at least primarily zinc indium sulfide.

20. An article as claimed in claim 4 in which said thin film coating is dominantly zinc indium sulfide.

21. An article as claimed in claim 5 in which said thin film coating is dominantly zinc indium sulfide.

22. An article as claimed in claim 6 in which said thin film coating is dominantly zinc indium sulfide.

23. An article as claimed in claim 1 in which the said thin film coating is doped with a dopant.

24. An article as claimed in claim 2 in which the said thin film coating is doped with a dopant.

25. An article as claimed in claim 3 in which the said thin film coating is doped with a dopant.

26. An article as claimed in claim 1 in which said thin film coating is doped with copper.

27. An article as claimed in claim 2 in which said film coating is doped with copper.

28. An article as claimed in claim 3 in which said thin film coating is doped with copper.

29. An article as claimed in claim 1 in which the said thin film coating is doped with iodine.

30. An article as claimed in claim 2 in which the said thin film coating is doped with iodine.

31. An article as claimed in claim 3 in which the said thin film coating is doped with iodine.

32. An article as claimed in claim 3 in which said thin film coating is about 3000 Angstroms thick and said film layer is less than 1000 Angstroms thick.

33. An article as claimed in claim 5 in which said thin film coating is about 3000 Angstroms thick and said thin film layer less than 1000 Angstroms thick.

34. An article as claimed in claim 6 in which said thin film coating is about 3000 Angstroms thick and said film layer is less than 1000 Angstroms thick.

35. An article as claimed in claim 3 in which said thin film layer is at least primarily indium oxide.

36. An article as claimed in claim 4 in which said means to facilitate charging are at least primarily indium oxide.

37. An article as claimed in claim 5 in which said thin film layer is at least primarily indium oxide.

38. An article as claimed in claim 6 in which said thin film layer is at least primarily indium oxide.

39. An article as claimed in claim 7 in which said thin film layer is at least primarily indium oxide.

40. An article as claimed in claim 8 in which said thin film layer is at least primarily indium oxide.

41. An article as claimed in claim 35 in which the thin film layer also includes a small amount of tin oxide.

42. An article as claimed in claim 36 in which the thin film layer also includes a small amount of tin oxide.

43. An article as claimed in claim 37 in which the thin film layer also includes a small amount of tin oxide.

44. An article as claimed in claim 38 in which the thin film layer also includes a small amount of tin oxide.

45. An article as claimed in claim 39 in which the thin film layer also includes a small amount of tin oxide.

46. An article as claimed in claim 40 in which the thin film layer also includes a small amount of tin oxide.

47. The article as claimed in claim 6 in which means are provided for increasing the bonding of said thin film layer and thin film coating to the substrate means.

48. The article as claimed in claim 47 in which said bond increasing means comprises a second thin film layer of a transparent wholly inorganic material between the first thin film layer and the substrate means.

49. The article as claimed in claim 48 in which the second thin film layer is a photoconductor and has a thickness that is a small fraction of the first thin film layer.

50. The article as claimed in claim 49 in which the thin film layers are cadmium sulfide.

51. In an electrophotographic member which includes a substantially transparent thin film coating of a sputtered semiconductor on a flexible substrate of insulative material with a thin film, flexible transparent ohmic layer sandwiched between the coating and substrate; the improvement comprising; said coating being wholly inorganic, microcrystalline, flexible, substantially transparent, having the crystals thereof oriented uniformly generally vertically relative to the surface of the substrate to which the coating is applied, substantially free of effective barrier layers between the crystals, the coating having a dark resistivity of at least $10^{12}$ ohm-centimeters and a ratio of dark to light resistivities of at least $10^4$ and being electrically anisotropic whereby to be capable of accepting a charge and retaining same to such a degree as to enable toning.

52. The article as claimed in claim 51 in which there is a thin film bonding layer of substantially the same material as the thin film coating interposed between the ohmic layer and the substrate but having a thickness substantially less than either the coating or the ohmic layer.

53. The article as claimed in claim 51 in which means are provided to establish electrical contact from said ohmic layer to circuitry exterior of the article.

54. The article as claimed in claim 51 in which the ohmic layer is a semiconductor.

55. For use with electrophotographic members or the like, a thin film photoconductive coating r.f. sputter deposited upon a suitable substrate, said coating being wholly inorganic, microcrystalline in highly ordered uniform arrangement, oriented generally vertically relative to the surface of the substrate, substantialy free of effective barrier layers between the crystals, being an n-type semiconductor, being chemically stable and abrasion resistant, having high photoelectric gain, having uniform morphology and stoichiometry, being electrically anisotropic whereby it is capable of accepting and retaining a charge to a degree enabling toning, the dark resistivity of said coating being at least $10^{12}$ ohm-centimeters and the ratio of dark to light resistivities being at least $10^4$.

56. The photoconductive coating as claimed in claim 55 in which said coating has a transmissivity between 70 and 85 percent.

57. The photoconductive coating as claimed in claim 55 in which the photoconductive coating is substantially transparent.

58. The photoconductive coating as claimed in claim 55 in which the coating is flexible.

59. The photoconductive coating as claimed in claim 55 in which the coating is cadmium sulfide about 3000 to 5000 Angstroms thick.

60. The photoconductive coating as claimed in claim 55 in which the dark resistivity is substantially increased upon charging in darkness.

61. The photoconductive coating as claimed in claim 56 in which the dark resistivity is substantially increased upon charging in darkness.

62. The photoconductive coating as claimed in claim 58 in which the dark resistivity is substantially increased upon charging in darkness.

63. The photoconductive coating as claimed in claim 59 in which the dark resistivity is substantially increased upon charging in darkness.

64. The photoconductive coating as claimed in claim 59 in which the coating is doped with a dopant.

65. In an electrophotographic film structure which includes a substrate having a thin film ohmic layer bonded to a surface thereof and a wholly inorganic thin film photoconductive coating bonded to the ohmic layer and sandwiching the layer between the substrate and the coating, the improvement comprising a film structure having the following properties:

A. physical—the coating is microcrystalline, oriented uniformly generally vertical to the surface to which bonded, is substantially free of effective barrier layers between the crystals, is substantially inert to humidity, temperature variations and most radiation; has indefinite shelf life; is highly abrasion resistant; is very dense;

B. optical—the film structure has between 70 percent and about 85 percent light transmissivity; and when charged and exposed to a radiation pattern, has a broad generally unpeaked spectral response; and C. electrical—the coating is an n-type semiconductor; is electrically anisotropic; can accept and sustain a rapid charge at a tonable level to achieve toned resolution as great as 1000 lines/mm; has a surface resistivity of at least $10^{12}$ ohm-centimeters; has a relatively low light resistivity permitting total light discharge with practically no residual charge; and has no persistent photoconductivity.

66. An electrophotographic film structure as claimed in claim 65 which has the following additional properties:

A. physical—the substrate, layer and coating are flexible and capable of being rolled to a diameter of less than ½ inch without damage, the total thickness of the coating and layer is about 5000 A; and B. electrical—the coating has a speed of discharge during exposure comparable with that of high speed conventional photographic film.

67. The structure as claimed in claim 66 in which the coating is cadmium sulfide.

68. The structure as claimed in claim 65 in which there is a thin film bonding layer between the ohmic layer and the substrate member of substantially the same material as said coating and having a thickness substantially less than that of said ohmic layer.

69. The structure as claimed in claim 66 in which there is a thin film bonding layer between the ohmic layer and the substrate member of substantially the same material as said coating and having a thickness substantially less than that of said ohmic layer.

70. The structure as claimed in claim 67 in which there is a thin film bonding layer between the ohmic layer and the substrate member of substantially the same material as said coating and having a thickness substantially less than that of said ohmic layer.

71. The structure as claimed in claim 67 in which the layer is indium oxide.

72. The structure as claimed in claim 67 in which the layer is a combination of indium oxide with a lesser amount of tin oxide.

73. In an electrophotographic member of the type having a photoconductive coating which is initially uniformly charged and thereafter exposed to a pattern of nonuniform radiation providing photons for selective discharge of the uniform charge to provide a latent image of remaining charge corresponding to the pattern of the nonuniform radiation the improvement comprising:

A. a substrate of insulating material

B. a photoconductive coating carried as a deposit upon the substrate and characterized by the following properties:

1. made of wholly inorganic material,
2. r.f. cathodic sputtered
3. generally uniformly vertically oriented crystalline,
4. of a sufficient thickness to enable absorption of relatively few photons to be sufficient to provide total discharge of the exposed surface,
5. n-type,
6. providing a substantial number of recombination centers,
7. having a dark resistivity greater than $10^{12}$ ohm-centimeters considered statically and substantially greater than $10^{12}$ ohm-centimeters considered dynamically,
8. a ratio of dark to light resistivity of at least $10^4$,
9. chemically stable and abrasion resistant,
10. electrically anisotropic,
11. being capable of accepting and retaining a charge to a degree to enable it to be exposed and toned and
12. is substantially free of effective barrier layers between the crystals and C. means including a generally electrically conductive plane in association with the substrate to enable charging of the photoconductive coating by corona or the like, the combining centers being independent of the electrical plane such that said means to enable charging of said coating are neither used nor required during discharge thereof.

74. The electrophotographic member as claimed in claim 73 in which the electrical plane is located between the substrate and the coating.

75. The electrophotographic member as claimed in claim 73 in which the electrical plane comprises a layer of ohmic material sandwiched between the substrate and the coating, the layer and coating and substrate all being intimately bonded together.

76. The electrophotographic member as claimed in claim 75 in which the ohmic material is conductive in at least one transverse direction.

77. A method for manufacturing an electrophotographic film article which comprises:

depositing a thin film layer of ohmic material upon a flexible thin organic transparent substrate in thoroughly bonded condition and a thickness which renders said thin film layer substantially transparent and flexible and r.f. direct cathodic sputtering a thin, electrically anisotropic film coating less than one micron in thickness of a wholly inorganic photoconductor material upon said ohmic material in a generally uniformly vertically oriented microcrystalline, substantially free of effective barrier layers between the crystals, thoroughly bonded condition and a thickness which provides a gain of said photoconductor material which is hight and which is substantially transparent and flexible, the total thickness of said article having a light transmissivity of not less than 70 percent and not more than about 85 percent, in which the sputtering is carried out in a chamber having an anode and a cathodic target formed of the material to be sputtered under conditions producing the usual dark space at the target, connecting the cathodic target to the high side of an r.f. generator and maintaining the anode on the negative side of ground whereby to produce a second dark space during sputtering.

78. The method as claimed in claim 77 in which the photoconductor material is doped during deposit by introducing a dopant into said r.f. field.

79. The method as claimed in claim 77 in which there is an extremely thin bonding layer of the same material as said coating is r.f. sputtered onto the substrate before the ohmic layer is deposited.

80. The method as claimed in claim 77 in which the ohmic layer is deposited by sputtering.

81. The method as claimed in claim 77 in which the ohmic layer is deposited by sputtering.

82. The method as claimed in claim 80 in which the sputtering is carried out in a chamber having an anode and a cathodic target formed of the material to be sputtered under conditions producing the usual dark space at the target, connecting the cathodic target to the high side of an r.f. generator and maintaining the anode on the negative side of ground whereby to produce a second dark space during sputtering.

83. In a method of manufacturing an article wich includes a substrate and a photoconductive coating bonded to the substrate, the step of depositing a thin film photoconductive coating on the substrate comprising the steps of establishing in a sputtering chamber a plasma between a cathodic target of photoconductive material to be sputtered and an anode carrying a substrate, connecting the cathodic target to the high negative side of the output of an r.f. generator and maintaining the anode below ground whereby to establish a Langmuir dark space between the plasma and the anode in addition to the ordinary dark space, and continuing the sputtering until a thin, electrically anisotropic film coating including said photoconductive material is coated upon a surface of said substrate in a uniformly ordered, microscrystalline layer with the crystals oriented uniformly generally vertically relative to said substrate surface, substantially free of effective barrier layers between the crystals.

84. The method as claimed in claim 83 in which the anode is heated.

85. The method as claimed in claim 83 in which the photoconductive material is cadmium sulfide.

86. The method as claimed in claim 85 in which hydrogen sulfide gas is introduced into the chamber as a background gas during the sputtering.

87. A method for manufacturing an electrophotographic article that is capable of being charged and toned and which comprises:

A. placing a substrate member having at least a surface that is conductive in an r.f. sputtering chamber in position to have the surface sputtered, the said surface being arranged to form substantially the anode in said chamber, B. positioning a target of a chemical compound formed of at least two inorganic elements and no organic elements in the chamber, the compound when sputtered producing a coating which is photoconductive in nature, C. connecting the target and anode in an r.f. sputtering circuit in which the target is effectively the cathode at a high negative voltage with respect to ground and the anode is negatively control-biased with respect to ground, D. sputtering in a non-reactive mode a coating of said compound onto the substrate to form a wholly inorganic photoconductive material on the substrate which is generally uniformly vertically oriented microcrystalline, substantially free of effective barrier layers between the crystals, electrically anisotropic, having a surface resistivity which is of the order of $10^{12}$ ohm-centimeters in lateral directions when charged in darkness or discharged in light and also transversely of the coating in darkness, and which has a light resistivity transversely of the coating which is of the order of $10^{8}$ ohm-centimeters or less, which is chemically stable and abrasion resistant and which is capable of accepting a charge and retaining it to a degree enabling the coating to be toned, E. the sputtering being carried on in an atmosphere that includes dominantly an inert but ionizable gas for forming a plasma between the target and substrate with a dark space at the target and the bias being such as to provide a second dark space at the substrate, with an additional background gas being introduced into the chamber along with the inert gas to prevent decomposition of the compound at the target or during deposition, and F. continuing the sputtering process until the thickness of the coating is at least sufficient to provide maximum photoconductive gain.

88. The method as claimed in claim 87 in which the compound is cadmium sulfide, the background gas is hydrogen sulfide and the bias voltage of the anode is substantially less than minus 200 volts.

* * * * *

UNITED STATES PATENT AND TRADEMARK OFFICE

CERTIFICATE OF CORRECTION

PATENT NO. : 4,025,339

DATED : May 24, 1977

INVENTOR(S) : MANFRED R. KUEHNLE

It is certified that error appears in the above-identified patent and that said Letters Patent are hereby corrected as shown below:

Col. 2, line 35, "Examples" should read --The thickness in all known examples--; Col. 2, line 45, change "relates" to --relate--; Col. 5, line 24, change "potnetials" to --potentials Col. 6, line 45, after "conductor" insert --compound--; Col. 15, line 51, change "1,000" to --1.000--; Col. 16, line 49, change "of" to --to--; Col. 18, line 9, change "$S_nb_2S$" to --$Sb_2S_3$--; Col. 19, line 57, before "photon" insert --one--; Col. 22, line 27, change "inention" to --invention--; Col. 22, line 39, change "by" to --be--; Col. 24, line 46, change "It is believed that the bias which is an important manufacturing parameter, helps bring about the results of the invention." to --It is believed that the bonding layer effectively seals the polyester substrate against outgassing which causes contamination of the photoconductive coating.--; Col. 27, line 20, change first occurrence of "of" to --or--; Col. 31, line 64, change "20" to -- -20--; Col. 32, line 24, change "1" to --one--; Col. 33, line 39, before "film" insert --thin--; Col. 33, line 57, before "film" insert --thin--; Col. 34, line 1, change "8" to --34--; Col. 37, line 19, change "hight" to --high--; Col. 37, line 50, change "wich" to --which--

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*